US010597179B2

(12) United States Patent
Menta et al.

(10) Patent No.: US 10,597,179 B2
(45) Date of Patent: Mar. 24, 2020

(54) AUTOMATIC RANDOM BOX SEALER AND METHOD OF SEALING BOXES OF DIFFERENT SIZES

(71) Applicant: Signode Industrial Group LLC, Glenview, IL (US)

(72) Inventors: William Joseph Menta, West Wyoming, PA (US); Bryce James Fox, Honesdale, PA (US)

(73) Assignee: Signode Industrial Group LLC, Glenview, IL (US)

( * ) Notice: Subject to any disclaimer, the term of this patent is extended or adjusted under 35 U.S.C. 154(b) by 626 days.

(21) Appl. No.: 15/167,272

(22) Filed: May 27, 2016

(65) Prior Publication Data

US 2017/0247129 A1 Aug. 31, 2017

Related U.S. Application Data

(60) Provisional application No. 62/301,186, filed on Feb. 29, 2016.

(51) Int. Cl.

| | |
|---|---|
| ***B65B 7/20*** | (2006.01) |
| ***B65B 57/04*** | (2006.01) |
| ***B65B 59/00*** | (2006.01) |
| ***B65B 51/02*** | (2006.01) |

(52) U.S. Cl.

CPC ..... *B65B 7/20* (2013.01); *B65B 51/02* (2013.01); *B65B 57/04* (2013.01); *B65B 59/00* (2013.01)

(58) Field of Classification Search

CPC ..... B65B 7/20; B65B 51/02; B65B 57/04; B65B 59/00

USPC ..... 53/491

See application file for complete search history.

(56) References Cited

U.S. PATENT DOCUMENTS

| | | | | | |
|---|---|---|---|---|---|
| 1,352,899 | A | * | 9/1920 | Johnson | B65B 7/20 53/376.5 |
| 1,779,985 | A | * | 10/1930 | Schroeder | B65B 7/20 493/183 |
| 2,691,260 | A | * | 10/1954 | Schlemmer | B65B 7/20 101/411 |
| 2,804,738 | A | * | 9/1957 | Shenigo | B65B 7/20 193/35 R |
| 3,046,715 | A | * | 7/1962 | Kent | B65B 59/00 53/231 |

(Continued)

OTHER PUBLICATIONS

Pepperl+Fuchs Group, Product Information for Model No. PMI810-F110-IU-V1, dated May 14, 2012 (3 pgs.).

(Continued)

*Primary Examiner* — Nathaniel C Chukwurah
*Assistant Examiner* — Lucas E. A. Palmer
(74) *Attorney, Agent, or Firm* — Neal, Gerber & Eisenberg LLP

(57) ABSTRACT

Various embodiments of the present disclosure provide a box sealer including a first box measurer including a top flap engager configured to move downwardly from a disengaged position above a box at a box measuring position to an engaged position in which the top flap engager engages one or more of the four upright open top flaps of the box. The amount of movement of the top flap engager is partially used to determine the height of the box. The determined height is then used to position a combined flap closer and flap sealer at an appropriate position.

20 Claims, 16 Drawing Sheets

(56) References Cited

U.S. PATENT DOCUMENTS 3,267,640 A * 8/1966 Romney ..... B65B 7/20 53/138.2
3,374,604 A * 3/1968 Roesner ..... B65B 7/20 493/14
3,716,962 A 2/1973 Langen et al.
3,769,777 A 11/1973 Miller et al.
3,775,937 A 12/1973 Devan et al.
3,959,950 A 6/1976 Fukuda
3,973,375 A 8/1976 Loveland
4,010,597 A 3/1977 Nelson
4,063,403 A 12/1977 Bergstein et al.
4,079,577 A 3/1978 Ulrich et al.
4,213,285 A 7/1980 Mancini
4,233,798 A 11/1980 Helding
4,293,086 A 10/1981 Fincher et al.
4,317,319 A 3/1982 Price
4,422,282 A * 12/1983 Marchetti ..... B65B 7/20 493/183
4,478,023 A 10/1984 Becker
4,517,784 A 5/1985 Beckett
4,524,560 A 6/1985 Goodman
4,543,767 A 10/1985 Wiseman
4,545,175 A 10/1985 Beckett
4,562,686 A 1/1986 Focke
4,565,050 A 1/1986 Norris
4,642,966 A * 2/1987 Marchetti ..... B65B 7/20 493/183
4,722,165 A * 2/1988 Marchetti ..... B65B 59/02 53/76
4,778,554 A 10/1988 Doman
4,781,786 A 11/1988 Lerner et al.
4,955,177 A 9/1990 Lerner et al.
4,972,654 A * 11/1990 Marchetti ..... B65B 7/20 493/179
4,984,409 A 1/1991 Focke
5,022,214 A 6/1991 Kim
5,063,726 A 11/1991 Boisseau
5,102,382 A 4/1992 Center et al.
5,255,490 A 10/1993 Chiu
5,323,586 A 6/1994 Lissoni et al.
5,341,626 A 8/1994 Beckmann
5,454,776 A 10/1995 Ulrich et al.
5,685,814 A 11/1997 Le
6,067,773 A 5/2000 Le
6,070,396 A 6/2000 Rinaldi et al.
6,318,049 B1 11/2001 Raudat et al.
6,319,183 B1 11/2001 Ballos, III
6,401,587 B1 6/2002 Beltrandi
6,725,629 B2 4/2004 Pearce et al.
6,910,314 B2 6/2005 Le
7,140,165 B2 11/2006 Ventura et al.
7,269,933 B2 9/2007 Le
7,278,248 B2 10/2007 Vinh Le
7,383,864 B2 6/2008 Hogerton et al.
7,886,503 B2 2/2011 Chase et al.
8,109,062 B2 2/2012 Chase et al.
2002/0170271 A1 11/2002 Pearce et al.
2004/0068956 A1 4/2004 Hartness et al.
2004/0093829 A1* 5/2004 Marchetti ..... B65B 7/20 53/75
2004/0226268 A1* 11/2004 Vinh Le ..... B65B 7/20 53/491
2005/0235603 A1* 10/2005 Le ..... B65B 51/067 53/136.4

OTHER PUBLICATIONS

Loveshaw, an ITW Company, Little David™ Case Sealer, LDXRTB 2.0 Series Random Top and Bottom Drive Fully Automatic Case Sealer Operator's Manual (100 pgs.).
Little David Case Sealer Uniform Legend, Case Sealing for the Real World, © Loveshaw, 2004 (2 pgs.).
The Loveshaw Corporation, Little David Owner's Manual LD16R, (59 pgs.).
Lenze AC Tech AC Drives SM Vector Drives NEMA 4X with Integral Disconnect, http://www.walkerindustrial.com/Lenze-AC-Tech-AC-Drives-SMVector-Drives-NEMA-4X-Disconnect-s/3675.htm (2 pgs.).
Leeson Electric Corp., Electric Motors, Gear Motors, and Drives, http://www.leeson.com/leeson/searchproduct.do?invoke=viewProductDetails&motorNo=096014.00&productType=0 (1 pgs.).

* cited by examiner

AUTOMATIC RANDOM BOX SEALER AND METHOD OF SEALING BOXES OF DIFFERENT SIZES

PRIORITY CLAIM

This application claims priority to and the benefit of U.S. Provisional Patent Application No. 62/301,186, which was filed on Feb. 29, 2016, the entire contents of which are incorporated herein by reference.

BACKGROUND

Millions of products are packed in containers or cases such as cardboard boxes for shipping on a daily basis throughout the world. Such boxes are typically rectangular and typically have four central walls (including two spaced-apart end or minor walls and two spaced-apart side or major walls), four bottom flaps (including two spaced-apart end or minor flaps and two spaced-apart side or major flaps), and four top flaps (including two spaced-apart end or minor flaps and two spaced-apart side or major flaps). The bottom end and side flaps of the box are closed before the box is filled with any products or packaging materials. After the box is filled, the open top end and side flaps are respectively folded inwardly and downwardly. The bottom and top ends of the box are sealed by applying tape to the outside surfaces of each of the bottom and top side flaps.

Many different types of automatic box sealers have been known and have been commercially available in the packaging industry. One type of known box sealer is configured for handling boxes that are all uniform in size. These box sealers can typically be adjusted to suit the known width and height of the uniformly sized boxes that they will close and seal.

Another known type of automatic box sealer configured for handling boxes that are not uniform in size is typically called a random size or random box sealer. The known random box sealers must be able to seal different size boxes that are used along the same conveyor line. These different size boxes are typically different in one or more of the width of the box, the length of the box, and the height of the box. These random box sealers must automatically adjust to suit the specific width, length, and height of each box. More specifically, these random box sealers must fold the top end and side flaps and then apply adhesive or tape thereto for each different size box.

Various sensors have been used in known random box sealers to try to determine the exact size of each box entering the random box sealer. Numerous actuators or other adjustment mechanisms together with suitable control devices have also been used to adjust the position of the various folding and sealing components of the known random box sealers to suit the size of each box being closed and sealed. There are many potential and actual issues or problems with various known random box sealers.

One such potential or actual issue or problem with various known random box sealers relates to packaging material. Packaging material such as plastic (e.g., bubble wrap) and paper is often used to protect the products placed in the boxes. If this packaging material sticks out of the top of the box above the top end or side flaps, the sensors and controllers used to determine the height of the box may incorrectly use the height of this packaging to determine the height of the box. If this incorrect measurement or interpretation is made, this can result in the box getting jammed in the box sealer, the box sealer not adequately closing and sealing the box, the box sealer damaging the box, and/or the box sealer damaging the box and the product(s) in the box.

Another such potential or actual issue or problem with various known random box sealers relates to the products in the boxes. Specifically, if the box is overfilled, the product(s) can stick out of the top of the box above the top end or side flaps, and the sensors and controllers used to determine the height of the box may incorrectly use the height of the products to determine the height of the box. If this incorrect measurement or interpretation is made, this can result in the box getting jammed in the box sealer, the box sealer not adequately closing and sealing the box, the box sealer damaging the box, and/or the box sealer damaging the box and the product(s) in the box.

Another potential or actual issue or problem with various known random box sealers relates to the bottom end and side flaps of the box. In certain instances, when the bottom end and side flaps are closed, they are not completely closed or sealed and thus the bottom of the box is not completely flat. In other words, sometimes the bottom of the box is bowed downwardly. This causes the box to sit up higher on the conveyor(s) as the box moves through the random box sealer, and thus can cause the known sensors and controllers used to determine the height of the box to incorrectly determine the height of the box. If this incorrect measurement or interpretation is made, this can result in the box getting jammed in the box sealer, the box sealer not adequately closing and sealing the box, the box sealer damaging the box, and/or the box sealer damaging the box and the product(s) in the box.

Another potential or actual issue or problem with various known random box sealers relates to the sensors used to measure the height of the box and specifically the height of the top end or side flaps. Various known sensors (such as light curtain sensors) can provide inaccurate readings for a variety of reasons. For instance, these sensors can be incorrectly installed or incorrectly calibrated. These sensors can also become dirty. These sensors may also have only limited accuracy. In such cases, the sensors and controllers used to determine the height of the box may incorrectly determine the height of the box. If this incorrect measurement or interpretation is made, this can result in the box getting jammed in the box sealer, the box sealer not adequately closing and sealing the box, the box sealer damaging the box, and/or the box sealer damaging the box and the product(s) in the box.

Another potential or actual issue or problem with various known random size box sealers relates to the sensors used to measure the height of the box and specifically the height of the top end and side flaps. These sensors are typically relatively expensive and thus make the known random box sealers relatively expensive.

Accordingly, there is a need for new and improved random box sealers and methods for automatically sealing boxes of different sizes that solve these problems or issues.

SUMMARY

Various embodiments of the present disclosure provide an automatic random box sealer and method for sealing boxes of different sizes that solve the above problems and issues.

The automatic random box sealer of various embodiments of the present disclosure includes a control system; a conveyor system including one or more conveyers; a first box measurer operable with the control system to determine the height of each box; a second box measurer operable with the control system to determine the width of each box; a flap closer operable with the control system to close the open top flaps of each box based on the determinations of the height and width of the box collectively made by the control system, the first box measurer, and the second box measurer; and at least one tape applicator operable with the control system to seal each box based on the determinations of the height and width of the box collectively made by the control system, the first box measurer, and the second box measurer. In certain embodiments, the flap closer and one of the tape applicators are combined or attached to each other.

In various embodiments of the present disclosure, the first box measurer includes at least one carriage or top flap engager that moves downwardly and engages the top edge of each of one or more of the upright open top end and/or side flaps of the box.

In various embodiments of the present disclosure, the first box measurer includes an inductive positioning system that determines how far the carriage or top flap engager travels downwardly until contacting the upright open top end and/or side flaps. In various embodiments, the inductive positioning system provides 65,000 counts or measurements over a 20 inch distance of travel and is therefore extremely accurate.

In various embodiments of the present disclosure, the carriage or top flap engager makes physical contact with the upright open top end and/or side flaps, and specifically the leading upright top end flap, a leading portion of the upright first top side flap, and a leading portion of the upright second top side flap. By engaging three of these upright open top flaps on the leading side of the box, the carriage is most likely to stop at the correct position relative to the box and thus enable accurate determination of the height of the box with the upright open top flaps.

In various embodiments of the present disclosure, the first box measurer includes a suitable pressure regulator that prevents the carriage or top flap engager from applying too much force to the top edges of the upright open top end and side flaps of the box. In various embodiments of the present disclosure, the pressure regulator is also set to enable the carriage or top flap engager to apply enough force or pressure to the upright open top end and side flap of the box to push down the bottom flaps and eliminate any bowing of the bottom flaps during the determination of the height of the box.

Thus, the random box sealer of the present disclosure overcomes the box height determination problems caused by the bottom end and side flaps of the box not fully closing, and in such cases the bottom of the box not being flat.

The random box sealer of the present disclosure also overcomes the box height determination problems caused by packaging material sticking out of the top of the box because the carriage or top flap engager engages the upright open top flaps of the box.

Likewise, the random box sealer of the present disclosure also overcomes the box height determination problems caused by products sticking out of the top of the box because the carriage or top flap engager engages the upright open top flaps of the box.

The random box sealer of the present disclosure also overcomes the box height determination problems caused inaccurate sensor readings due to incorrectly installed, incorrectly calibrated, or dirty sensors.

The random box sealer of the present disclosure also overcomes the relatively high cost of certain sensors (such as light curtains), and thus reduces the overall cost of the automatic random box sealer of the present disclosure.

Additional features and advantages of the present disclosure are described in, and will be apparent from, the following Detailed Description and the Figures.

DETAILED DESCRIPTION

Figure 1:
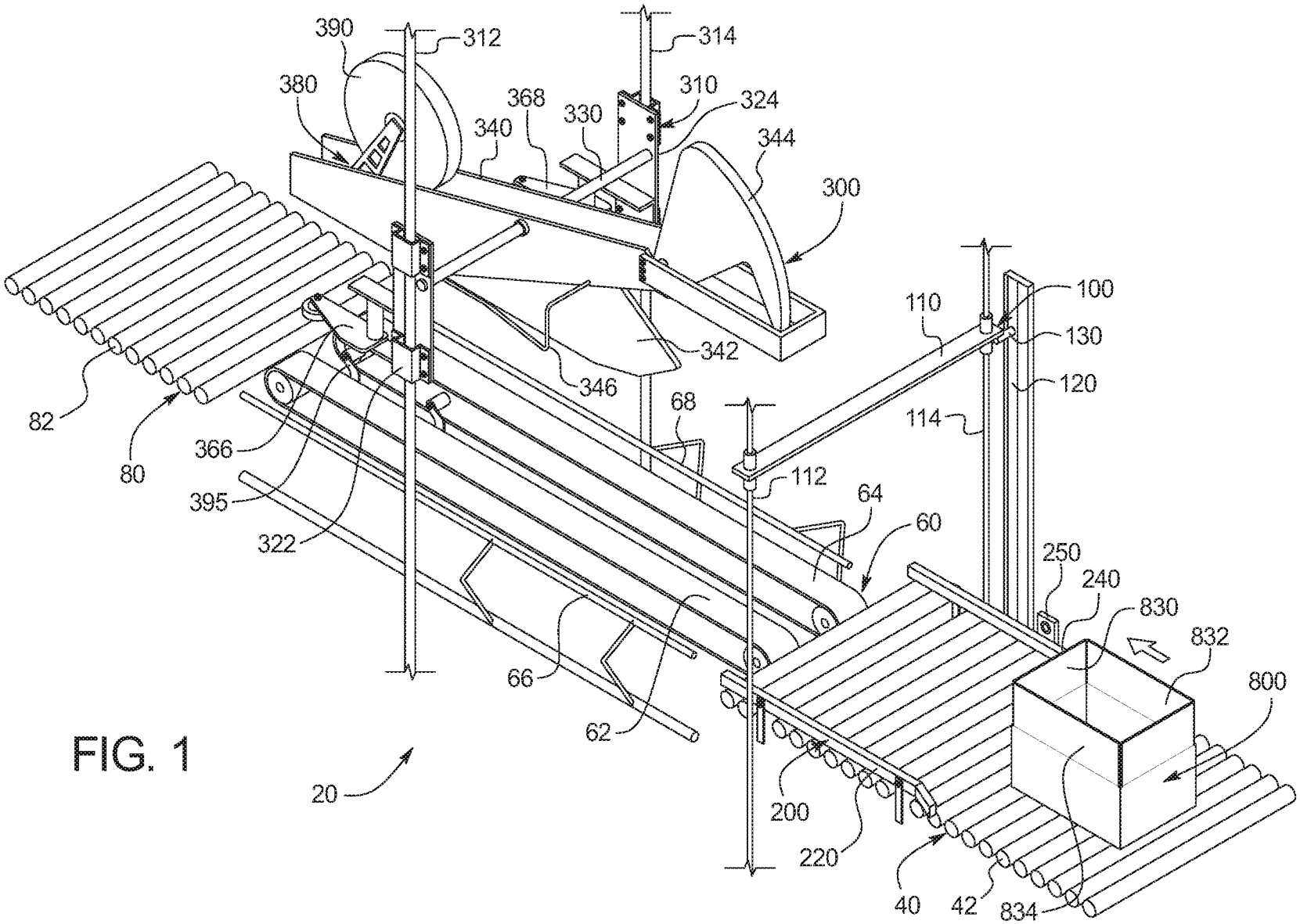
FIG. 1 is a diagrammatic perspective view of an automatic random box sealer of one example embodiment of the present disclosure.

Referring now to the drawings, FIGS. 1 to 16 diagrammatically illustrate one example embodiment of the automatic random box sealer of the present disclosure. The automatic random box sealer is generally indicated by numeral 20. A method of sealing boxes using this example automatic random box sealer is also generally shown in FIGS. 1 to 16. The automatic random box sealer 20 may sometimes be referred to herein as the random box sealer, the automatic box sealer, the box sealer, or the sealer for brevity; however, it should be appreciated that such abbreviations are not meant to limit the scope of the present disclosure. It should also be appreciated that the term "upright" as used throughout the present application when referring to each of the open top flaps of the box does not require that top flap to be open at a 90 degree angle, but rather includes the top flap being substantially upright or at any suitable angle (slightly less than or slightly more than 90 degrees) such that the top flap is not in a closed state or position. For example, upright is meant to include the flap being between an 85 degree angle and a 95 degree angle.

In this illustrated embodiment, the automatic random box sealer 20 is configured to automatically and continuously seal boxes of different or random sizes such as boxes 800, 850, and 900 (shown in FIGS. 1 to 16). In this illustrated example, each such box is rectangular and has: (a) two spaced-apart end or minor central walls extending the width of the box; (b) two spaced-apart side or major central walls extending the length of the box; (c) two spaced-apart end or minor bottom flaps extending the width of the box; (d) two spaced-apart side or major bottom flaps extending the length of the box; (e) two spaced-apart end or minor top flaps extending the width of the box; and (f) two spaced-apart side or major top flaps extending the length of the box.

In this illustrated embodiment, the automatic random box sealer 20 generally includes: (a) a conveyor system that includes one or more conveyers such as illustrated example conveyer 40, conveyer 60, and conveyor 80; (b) a first box measurer 100; (c) a second box measurer 200; (d) a combined flap closer and tape applicator 300; and (e) a control system (not shown).

The control system of the box sealer 20 is not shown in FIGS. 1 to 16, but controls, communicates with, and operates with the components of the box sealer 20 including the conveyer system 30, the first box measurer 100, the second box measurer 200, and the combined flap closer and tape applicator 300. The control system is configured to control movement or operation of at least part of the conveyer system 30, the first box measurer 100, the second box measurer 200, and the combined flap closer and tape applicator 300 as further discussed below. The control system is also configured to receive signals from the first box measurer 100 and the second box measurer 200 to determine the width and height of each box as further discussed below.

The illustrated conveyor system includes conveyer 40, conveyer 60, and conveyor 80 configured to operate together to move the different size or random size boxes to, into, through, out of, and from the box sealer 20 at the appropriate points in time and to the appropriate positions as further discussed below.

It should be appreciated that for purposes of this disclosure, various conventional parts of the automatic random box sealer are excluded for illustrative clarity. For example, various support structures, protective housings, wires, drive mechanisms, and electrical components are excluded from the Figures for illustrative clarity.

The conveyer 40 generally includes a series of rollers 42 configured to support and direct each box as each box is received from a conveyor belt (not shown) associated with a box filling station (not shown).

The conveyer 40 is powered by one or more drive assemblies (not shown) and operates under the control of the control system. It should be appreciated that a further conveyor (not shown) that delivers boxes to conveyor 40 could be part of the box sealer of the present disclosure or could be separate from the box sealer of the present disclosure. It should also be appreciated that the conveyor 40 is configured to deliver each box to a box measuring position (shown in FIGS. 3, 4, 5, 6, 9, 10, 11, 12, 13, 14, 15, and 16). It should further be appreciated that the conveyor 40 is configured to move or direct each box from the conveyor 40 to the conveyor 60 after the box is measured at the box measuring position.

The conveyor 40 also includes a sensor such as a photo eye (not shown) which operates with the control system to cause the conveyor 40 to stop the travel of the box on the rollers 42 when the box reaches the box measuring position.

The conveyer 60 includes a series of substantially parallel extending conveyer belts 62 and 64 powered by one or more drive assemblies (not shown). The conveyor 60 is configured to support and move each box (received from the box measuring position on the conveyor 40) to and under the combined flap closer and tape applicator 300. More specifically, the conveyor 60 is configured to move each box to the flap closing positions (shown in FIGS. 7, 8, 9, and 10) and to the flap sealing positions (shown in FIGS. 11 and 12). The conveyor 60 operates under the control of the control system. The conveyer 60 also includes box guides 66 and 68 powered by one or more drive assemblies (not shown) and configured to guide each box as the box passes to, under, and from the combined flap closer and tape applicator 300. The box guides 66 and 68 operate under control of the control system and are configured to move (such as by rotation or pivoting) from a box disengaged position (shown in FIGS. 1, 2, 3, 4, 5, 6, 13, 14, 15, and 16) to a box engaging position (shown in FIGS. 7, 8, 9, 10, 11, and 12).

In an alternative embodiment, the conveyer belts 62 and 64 are replaced by opposing side box drive assemblies (not shown) configured to engage the opposite sides of each box to move each box to, under, and from the combined flap closer and tape applicator 300. In one such embodiment, each box slides along one or more low friction plastic supports as the side box drive assemblies that box. In this alternative embodiment, the side drive assemblies also function to center each box as it moves to, under, and from the combined flap closer and tape applicator 300.

The conveyor 80 generally includes a series of rollers 82 configured to support and direct each box as each box is received from conveyor 60. It should be appreciated that conveyor 80 can be part of the box sealer of the present disclosure or could be a separate assembly from the box sealer of the present disclosure. It should be appreciated that the conveyor 80 may include one or more drive assemblies. It should also be appreciated that if conveyor 80 is part of the box sealer of the present disclosure, it may be controlled by the control system.

In this illustrated embodiment, the first box measurer 100 includes a horizontally extending carriage or top flap engager 110 configured to move upwardly and downwardly along two spaced-apart supports 112 and 114. The first box measurer 100 also includes one or more drive assemblies (not shown), electrical components (not shown), and an inductive positioning system (which is partially shown). The first box measurer 100 is in communication with and controlled by the control system. It should also be appreciated that the supports 112 and 114 are only diagrammatically illustrated for clarity, and that the supports and the carriage will include addition structures. It should be appreciated that any suitable controllable movable carriage system can be employed in the first box measurer of the present disclosure.

The inductive positioning system includes a stationary vertically or substantially vertically extending sensor 120 and a target 130 (such as a magnet) attached to the carriage or top flap engager 110. The sensor 120 is stationary and the target 130 moves relative to the sensor 120 as the carriage or top flap engager 110 moves.

In this example embodiment, the first box measurer 100 further includes a sensor such as a laser photo electric eye (not shown) attached to and positioned below the carriage to provide a horizontally extending beam below the carriage 110. After a box (such as box 800) is properly positioned at the box measuring position under the carriage 110, the carriage 110 moves downwardly along the supports 112 and 114 and when the sensor detects the top edges of one or more of: (a) the upright open top leading end flap 830, and (b) the leading portions of the upright open top side flaps 832 and 834 of the box 800, the sensor sends a signal to the control system and the control system cause the carriage 110 to slow down and coast to a stopping position or neutral position such that the carriage or top flap engager 110 makes physical contact with the upright open top flaps 830, 832, and 834, and specifically the leading top end flap 830, a leading portion of the top first side flap 832, and a leading portion of the top second side flap 834. In one such embodiment, after the sensor detects the top edges of the upright top flaps, the carriage moves downwardly 0.25 millimeters to engage the top edges of the flaps. By moving down this additional distance after the sensor senses the top edges of the upright top flaps, the carriage 110 will engage the three upright open top flaps on the leading side of the top of the box 800, will stop at the correct position relative to the box 800, and will apply the desired about of pressure to these flaps (without applying too much pressure).

Figure 3:
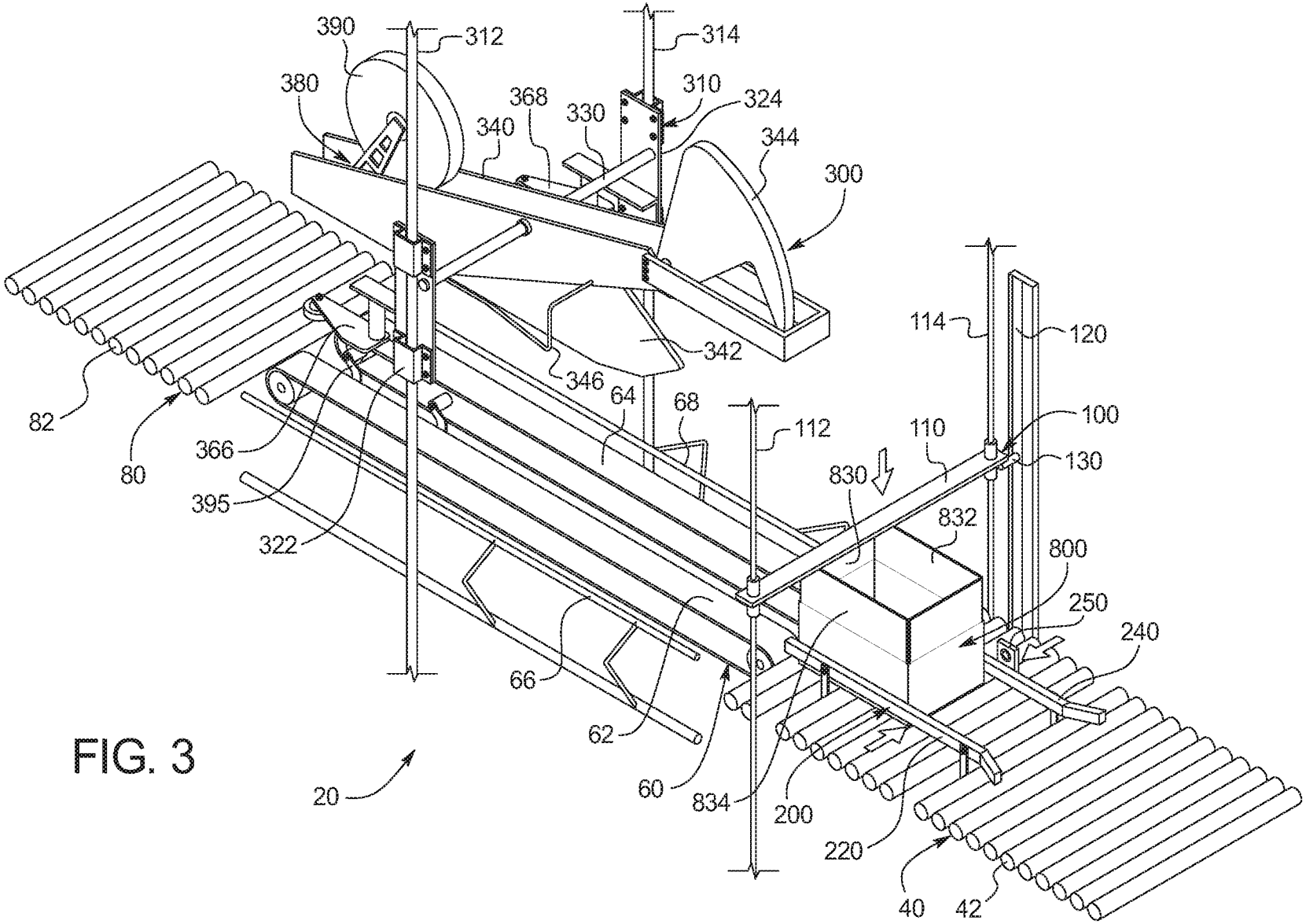
FIG. 3 is diagrammatic perspective view of the automatic random box sealer of FIG. 1, showing the first box measurer of the box sealer engaging three of the upright open top flaps of a first size box and the second box measurer of the box sealer engaging the sides of the first size box.
Figure 4:
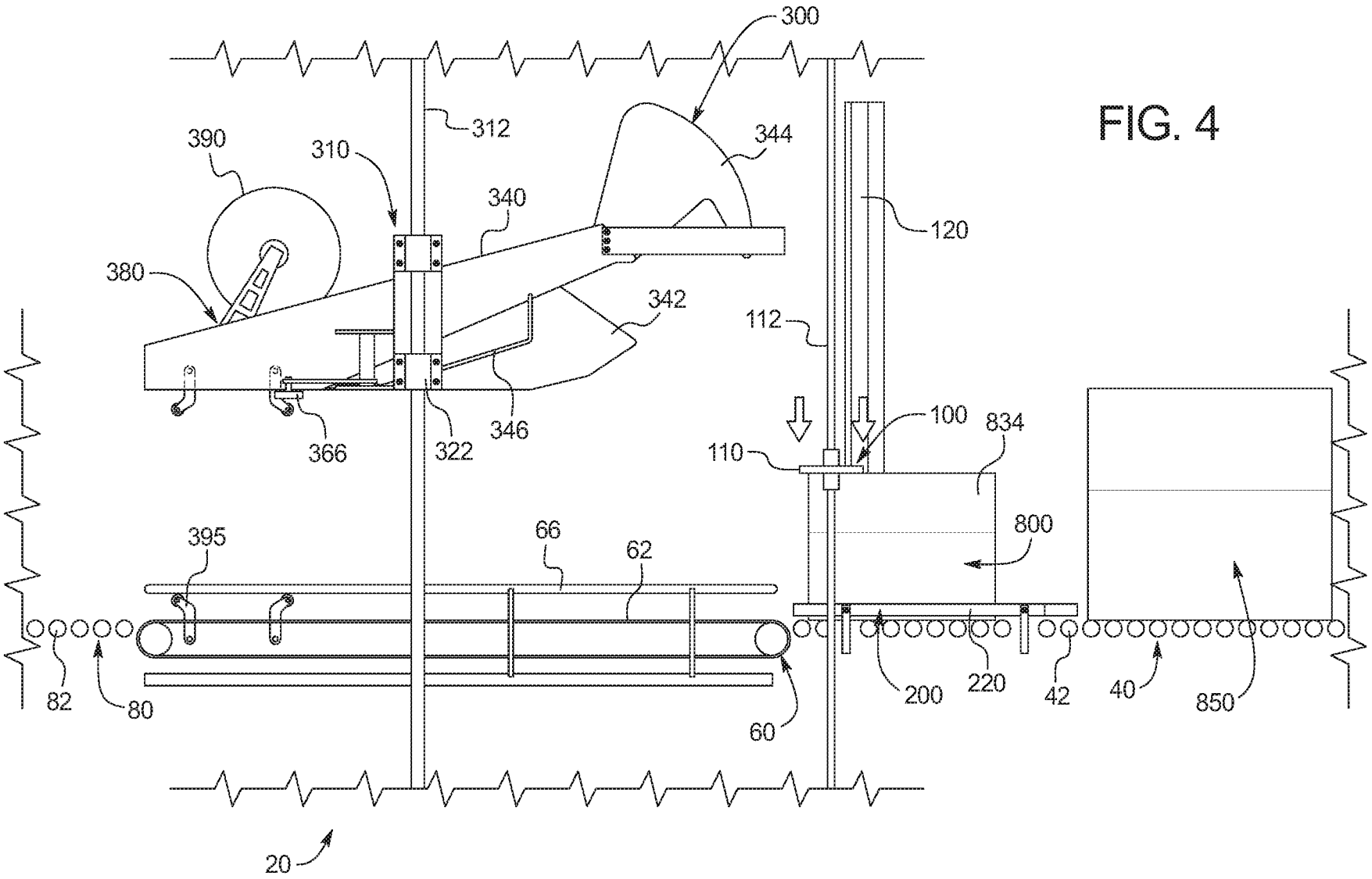
FIG. 4 is diagrammatic side view of the automatic random box sealer of FIG. 1, showing the first box measurer of the box sealer engaging three of the upright open top flaps of the first size box and the second box measurer of the box sealer engaging the sides of the first size box.

Thus, after a box (such as box 800) is properly positioned at the box measuring position under the carriage 110, the carriage 110 moves downwardly along the supports 112 and 114 and engages the top edges of each of: (a) the upright open top leading end flap 830; and (b) the leading portions of the upright open top side flaps 832 and 834 of the box 800 (as shown in FIGS. 3 and 4). The carriage or top flap engager 110 makes physical contact with the upright open top flaps 830, 832, and 834, and specifically the leading top end flap 830, a leading portion of the top first side flap 832, and a leading portion of the top second side flap 834.

It should be appreciated that in alternative embodiments, the carriage 110 can engage fewer than three of the upright open top flaps of the box. It should also be appreciated that in alternative embodiments, the carriage can be configured to engage all of the open top flaps. The automatic random box sealer of the present disclosure overcomes the box height determination problems described above.

In this embodiment, as mentioned above, the first box measurer 100 includes an inductive positioning system (partly shown in FIGS. 1 to 16) The inductive positioning system determines how far the carriage or top flap engager travels downwardly until contacting the upright open top flaps of the box. In various embodiments, the inductive positioning system provides 65,000 counts over a 20 inch distance of travel and is therefore extremely accurate. The inductive positioning system includes a stationary vertically or substantially vertically extending sensor 120 and a movable target 130 connected to the carriage 110.

In this embodiment, the first box measurer includes one or more air cylinders (not shown) and a suitable air pressure regulator (not shown) that regulates the movement of the carriage 110 and prevents the carriage or top flap engager 110 from applying too much force to the top edges of the upright open top end and side flaps of the box. The pressure regulator also enables the carriage or top flap engager to apply enough force to the upright open top end flaps to transfer enough force through the box to push down the bottom flaps and eliminate any bowing or tenting of the bottom flaps for the determination of the height of the box. This enables the random box sealer of the present disclosure to overcome the box height determination problems caused by the bottom end flaps and side flaps of the box not fully closing and in such cases the bottom of the box not being flat.

It should be appreciated that in other embodiments, the first box measurer can include one or more chain mechanisms that provide and regulate the movement of the carriage. It should also be appreciated that in other embodiments, the first box measurer can include one or more screw mechanisms that provide and regulate the movement of the carriage.

In this illustrated embodiment, the second box measurer 200 includes: (a) two movable centering arms 220 and 240 that engage the outside surfaces of the sides of each box when the box is positioned at the box measuring position; and (b) an ultrasonic sensor 250 attached to centering arm 240 and configured to measure the box width. More specifically, the two movable centering arms 220 and 240 are configured to move horizontally or substantially horizontally from first or box disengaged positions (shown in FIGS. 1, 2, 5, 6, 7, 8, 9, 10, 11, 12, 15 and 16) to box engaging positions (shown in FIGS. 3, 4, 13, and 14) to center the box on the conveyor 40 at the box measuring position. The ultrasonic sensor 250 of the second box measurer 200 measures the box width. More specifically, the ultrasonic sensor measures the distance that the side rail 240 travels inwardly and sends one or more signals regarding same to the control system which uses such data to determine the width of the box.

In alternative embodiments, the second box measurers includes an inductive positioning system to determine or measure the width of each box. In one such an embodiment, the sensor of the inductive positioning system extends between two rollers of the conveyor 40 and the target is attached to one of the centering arms 220 and 240.

The control system of the automatic random box sealer 20 of the present disclosure determines the dimensions of the box using signals received from the first box measurer 100 and the second box measurer 200, and based one or more formulas or equations relating to the dimensions of the boxes. Generally, these formulas or equations employ or rely on the main characteristic of theses boxes that half of the width of the box is the height of the top flaps of the box. In other words, the Box Height=(box height with flaps in the upright position)−(box width/2). Thus, by measuring or determining (a) the total height of the box with the bottom flaps closed and the top flaps open; and (b) the width of the box (from one side to the other side), the control system can determine the box height and to determine the exact height to set the combined flap closer and tape applicator 300 for each box in an accurate and reliable manner. The control system is configured to: (a) receive signals from the first box measurer and the second box measurer; (b) use those signals to determine the needed dimensions of each box; (c) set the height of the combined flap closer and tape applicator 300 based on the determination of the height of each box; and (d) set the positions of the guides 66 and 68. In this example embodiment, the first and second box measurers send or feed analog signals into a programmable logic controller of the control system. The programmable logic controller converts the analog signal into a digital value. The control system divides the width digital value by two and then subtracts that amount from the digital value of the overall height of the box with the top flaps in the upright open position. This results in the actual height of the box with all of the flaps closed. This actual height is used to adjust the combined flap closer and tape applicator 300 upwardly or downwardly for the box as further discussed below.

The automatic random box sealer of the present disclosure is thus configured to efficiently and accurately determine the height of each different box at the box measuring station, and to have a relatively high overall box throughput rate.

The combined flap closer and tape applicator 300 is configured to close each of the open top end and side flaps of each of the boxes and to apply tape to the closed top side flaps and center end walls of each of the boxes to seal each of the boxes. The combined flap closer and tape applicator 300 includes a horizontally extending carriage 310 configured to move upwardly and downwardly along two spaced-apart supports 312 and 314. The carriage 310 includes slide plates 322 and 323, a crossbar 330 attached to the slide plates 322 and 323, and an elongated support or support member 340 attached to the crossbar 330. The slide plates are configured to move up and down on the supports 312 and 314 under the control of the control system. The carriage 310 includes one or more drive assemblies (not shown) and is controlled by the control system. The illustrated example carriage 310 and specifically the support member 340 supports a flap closer 340 and the tape applicator 380 as further discussed below. It should be appreciated that any suitable controllable movable carriage system can be employed in the combined flap closer and tape applicator of the present disclosure.

The flap closer includes a stationary leading flap closer 342, a rotatable or pivotable trailing flap closer 344, a first side flap closer 346, and a second side flap closer (not shown).

Figure 7:
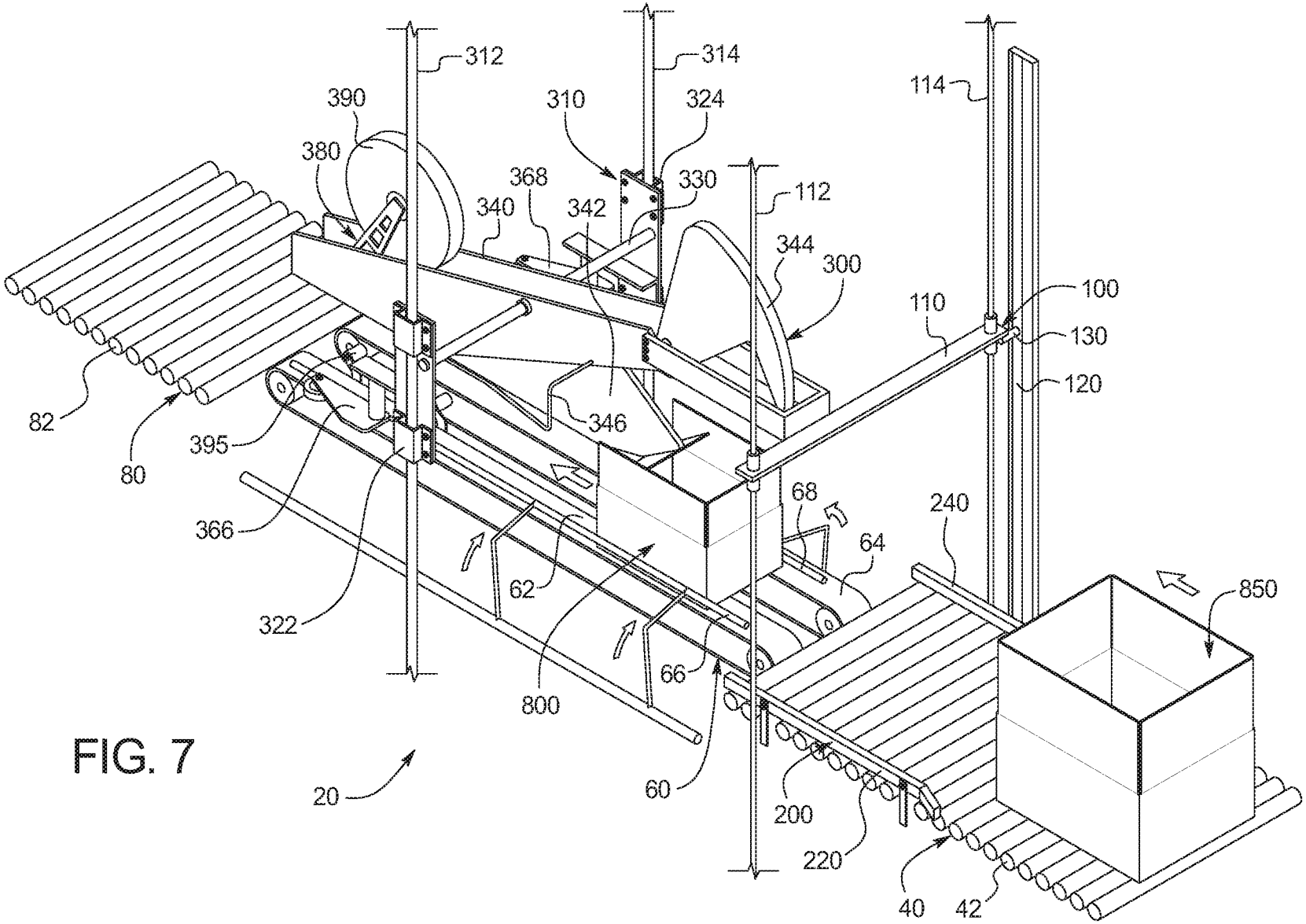
FIG. 7 is diagrammatic perspective view of the automatic random box sealer of FIG. 1, showing the combined flap closer and tape applicator closing the forward or leading upright open flap of the first size box.
Figure 8:
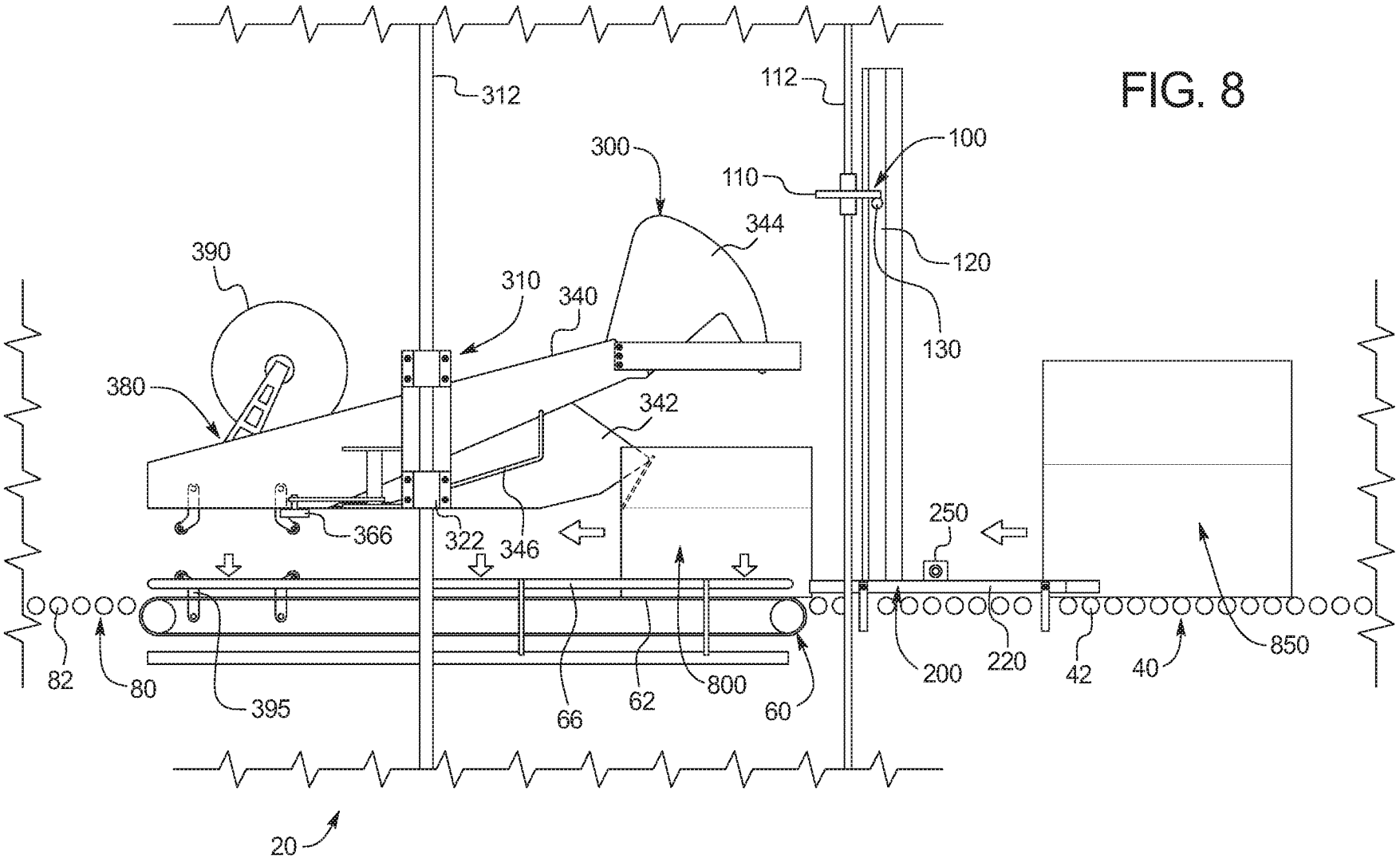
FIG. 8 is diagrammatic side view of the automatic random box sealer of FIG. 1, showing the combined flap closer and tape applicator closing the forward or leading upright open flap of the first size box.

More specifically, the stationary leading flap closer 342 is attached to the support 340 and is configured to engage and close the leading surface of the leading upright top end flap of each box as the box moves under the combined flap closer and tape applicator 300 (as shown in FIGS. 7 and 8).

Figure 9:
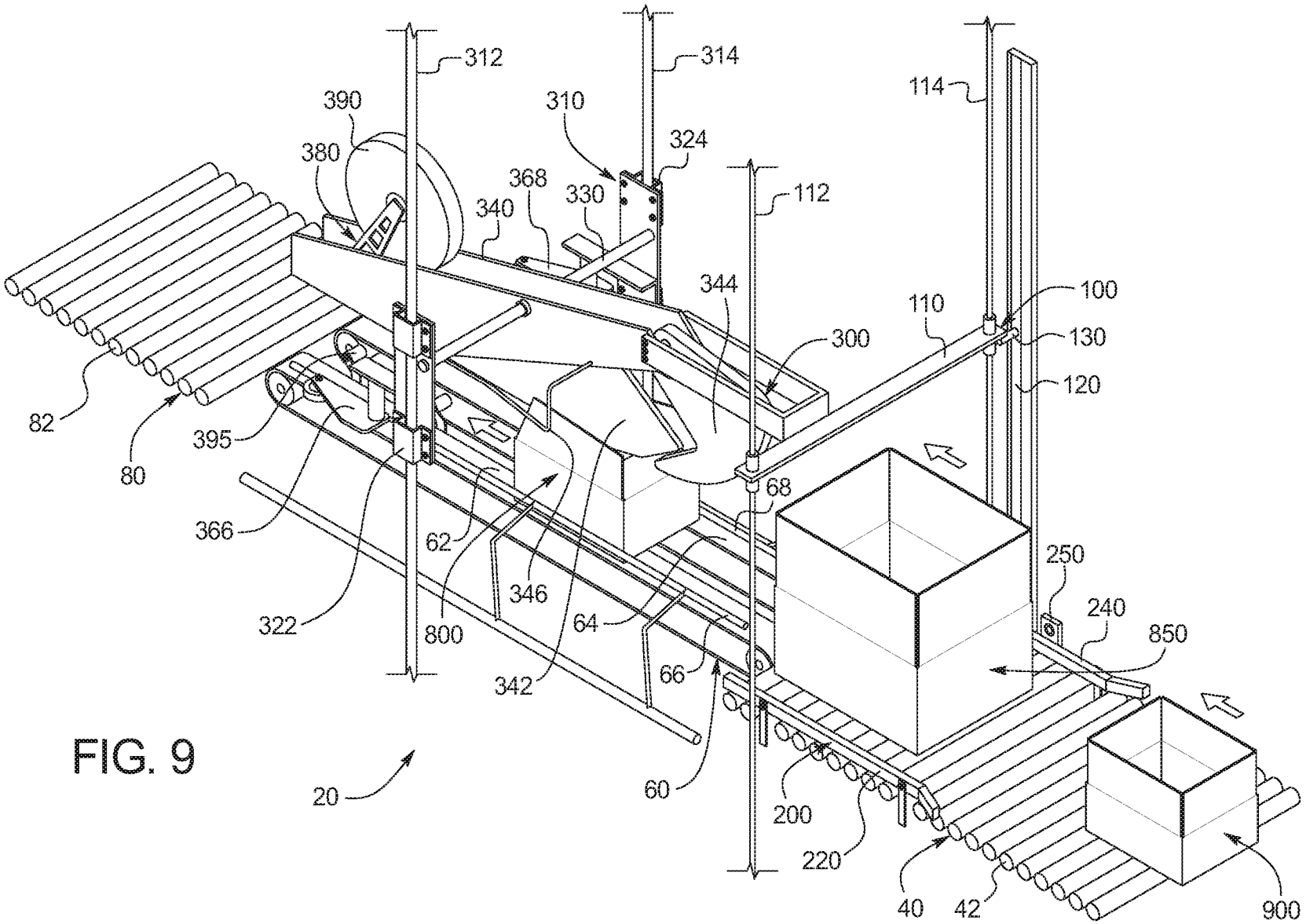
FIG. 9 is diagrammatic perspective view of the automatic random box sealer of FIG. 1, showing the combined flap closer and tape applicator closing the rearward or trailing upright open flap of the first size box, and a second larger size box positioned for measuring by the box measurer.
Figure 10:
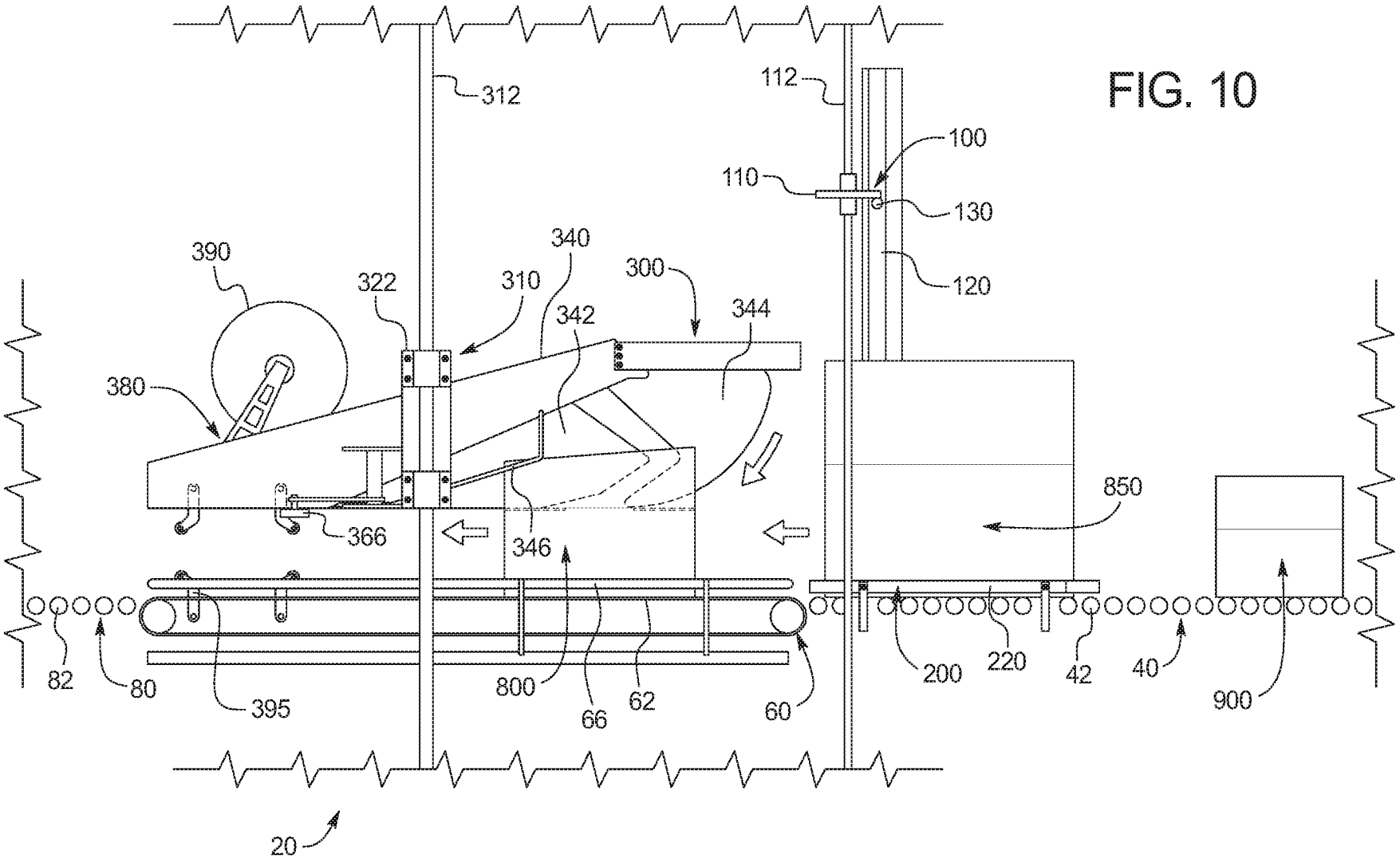
FIG. 10 is diagrammatic side view of the automatic random box sealer of FIG. 1, showing the combined flap closer and tape applicator closing the rearward or trailing upright open flap of the first size box, and a second larger size box positioned for measuring by the box measurer.

The rotatable or pivotable trailing flap closer 344 is downwardly rotatably or pivotally attached to the support 340, powered by a drive assembly (not shown), controlled by the control system, and configured to rotate or pivot downwardly to engage and close the trailing surface of the trailing upright open top end flap of each box as the box moves under the combined flap closer and tape applicator 300 (as shown in FIGS. 9 and 10).

Figure 12:
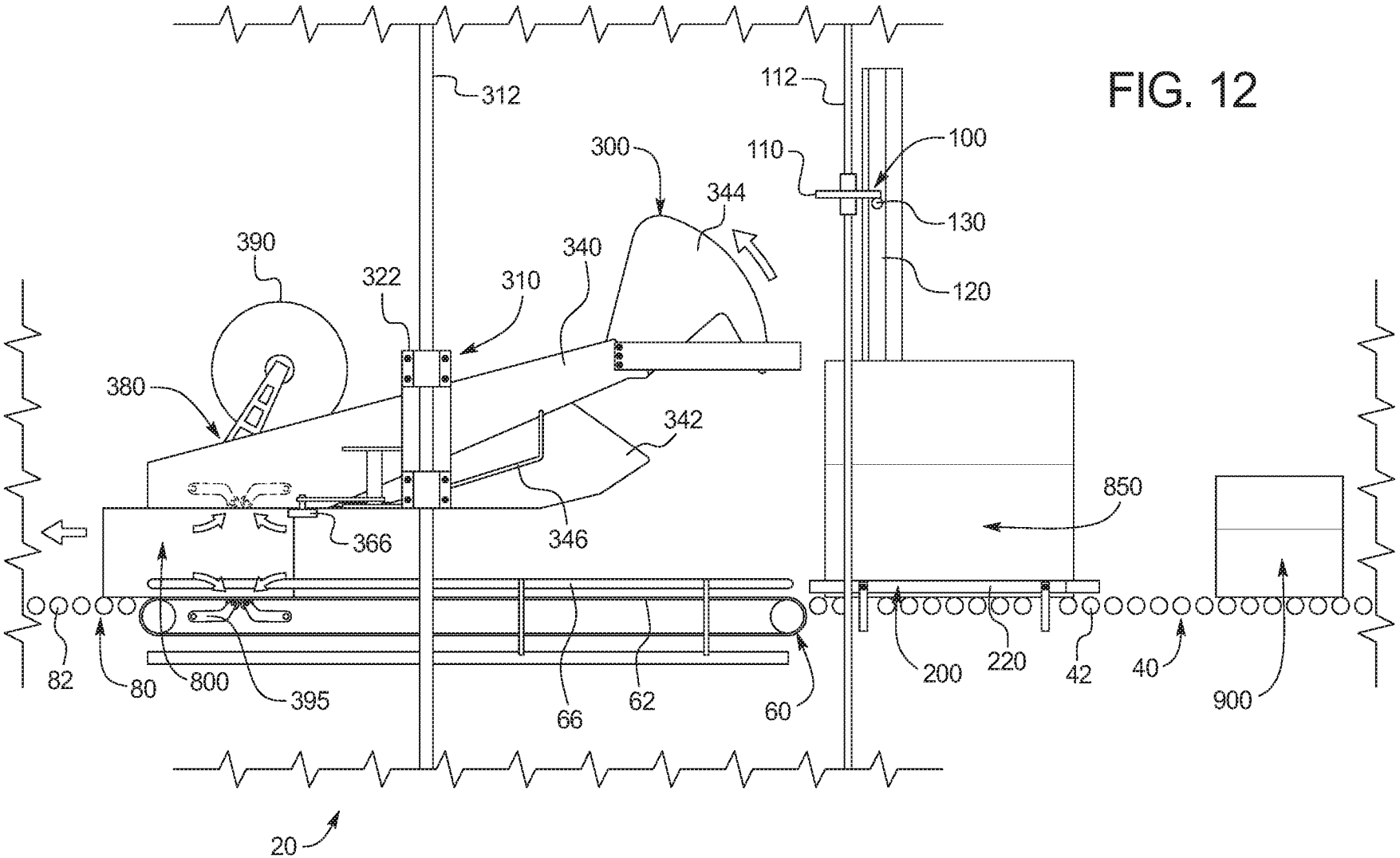
FIG. 12 is diagrammatic side view of the automatic random box sealer of FIG. 1, showing the combined flap closer and tape applicator applying tape to the closed flaps of the first size box, and a second larger size box positioned for measuring by the box measurer.
Figure 13:
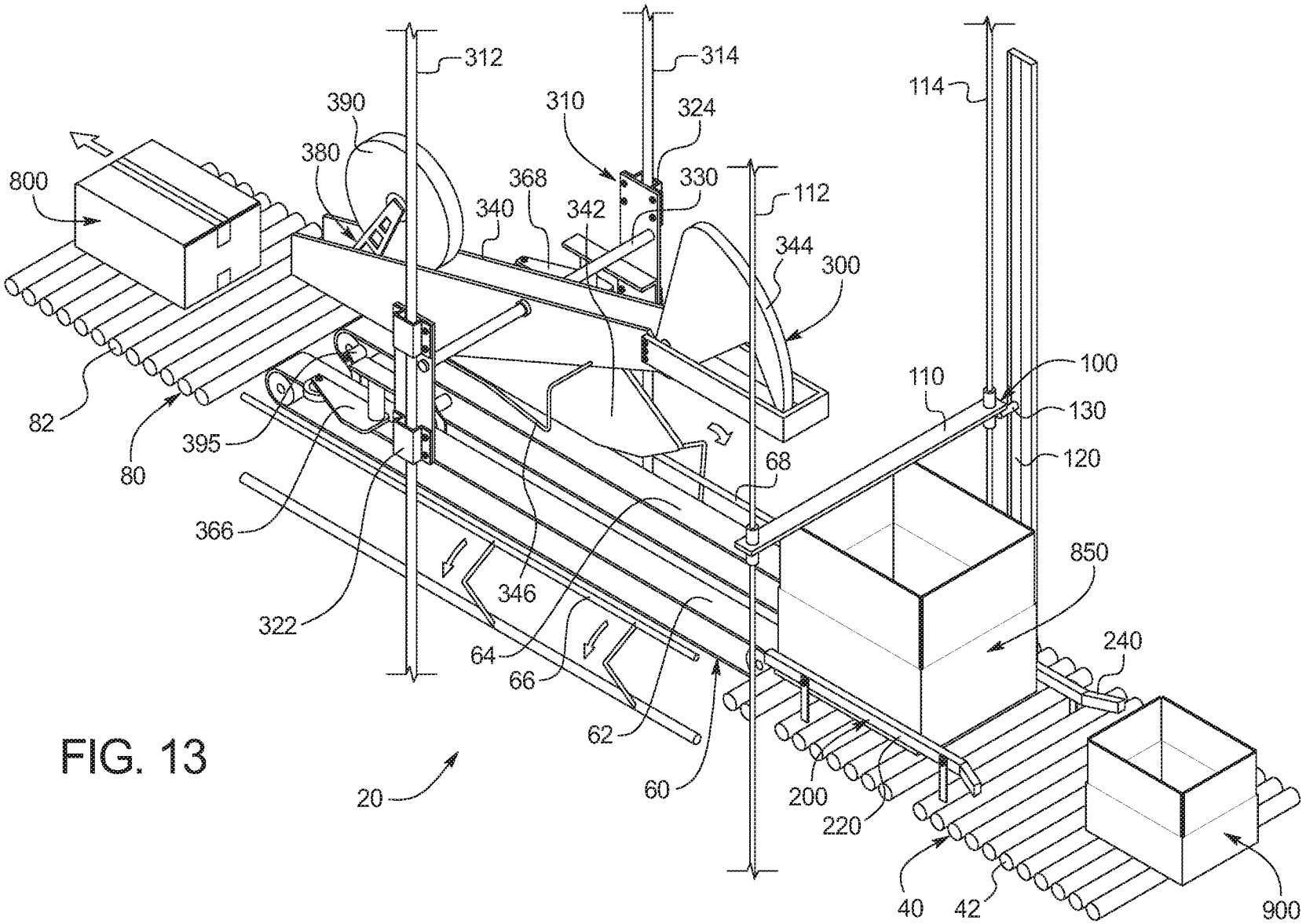
FIG. 13 is diagrammatic perspective view of the automatic random box sealer of FIG. 1, showing the first box measurer of the box sealer engaging three of the upright open top flaps of the second size box and the second box measurer of the box sealer engaging the sides of the second size box.

The first side flap closer 346 is attached to the support 340, and configured to engage and close the outer surface of the upright top left side flap of each box as the box moves under the combined flap closer and tape applicator 300 (as partially shown in FIGS. 12 and 13). Likewise, the second side flap closer (not shown) is attached to the support 340, and configured to engage and close the outer surface of the upright top right side flap of each box as the box moves under the combined flap closer and tape applicator 300. It should be appreciated that other suitable side flap closers may be employed in accordance with the present disclosure.

The combined flap closer and tape applicator 300 may further include one or more sets of top flap squeezers such as top flap squeezers 366 and 368 that ensure that the top side flaps are fully closed before the tape is applied to the top side flaps and center end wall of the box.

The tape applicator 380 of the combined flap closer and tape applicator 300 includes a tape roll supporter (partially shown) configured to support a roll of tape 390 and a top tape applier (not shown) which apply the tape to the closed top side flaps and end center walls of the box. The tape applier can be any suitable tape applier.

The box sealer 20 of this illustrated embodiment also includes a bottom tape applicator 395 configured to support a roll of tape (not shown) and to apply tape to the closed bottom side flaps and end center walls of the box. The bottom tape applicator can be any suitable tape applicator.

It should be appreciated that the flap closer and tape applicator do not need to be combined or connected in accordance with the present disclosure. In other words, in other embodiments of the automatic random box sealer of the present disclosure, the flap closer and the tape applicator can be separately and independently movable upwardly and downwardly. In such embodiments, the control system would independently control the flap closer and the tape applicator.

The automatic random box sealer 20 of the present disclosure further includes an additional tape applicator (partially shown) which applies tape to the closed bottom side flaps and the end central walls as the box moves over the box sealing positions. It should be appreciated that the automatic random box sealer of the present disclosure does not need to include this additional tape applicator if the bottoms of the boxes are sealed before they are processed by the automatic random box sealer of the present disclosure (such as before the products are placed in the boxes). This additional tape applicator can be any suitable tape applicator.

One operational method of the automatic random box sealer 20 of this illustrated example embodiment and thus one embodiment of the method of the present disclosure are generally shown in FIGS. 1 to 16 and discussed below. In this illustrated method, each box is measured, closed, and sealed (i.e., one at a time) before the next box is measured. In other alternative embodiments, to speed up the process, after each box is measured and moved to the flap closing and sealing station, the next box is positioned and measured by the first and second box measurers. This second method speeds up the overall process, and is more likely to be commercially implemented.

Figure 2:
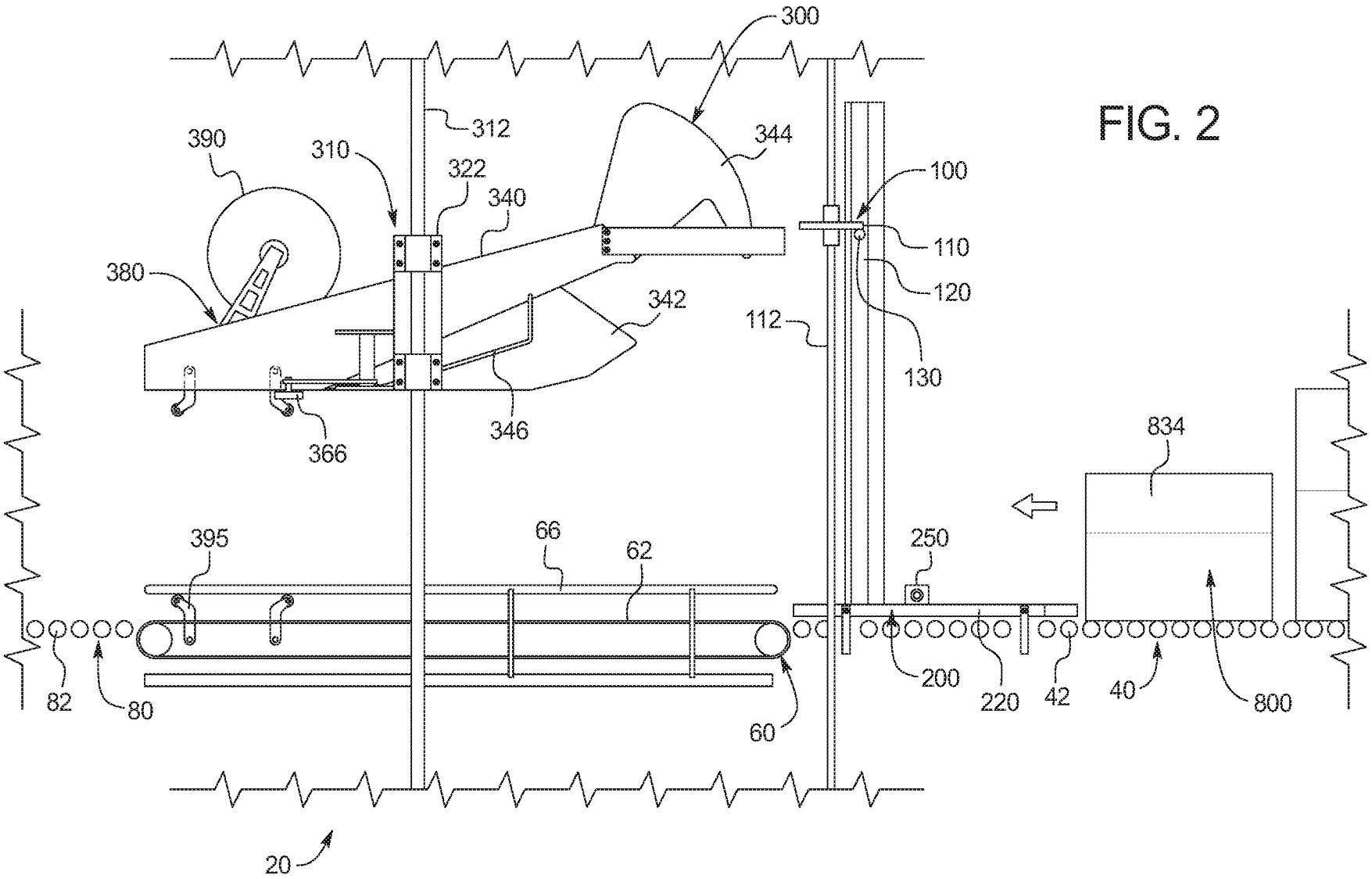
FIG. 2 is diagrammatic side view of the automatic random box sealer of FIG. 1.

More specifically, FIGS. 1 and 2 illustrate the automatic random box sealer 20 prior to measuring a box 800 of a first size. At this point in time: (a) box 800 has not yet reached the box measuring position on the conveyor 40; (b) the carriage or top flap engager 110 is in a disengaged position above the box measuring position; (c) the two movable centering arms 220 and 240 of the second box measurer 200 are in disengaged positions; (d) the box guides 66 and 68 are in disengaged positions, and (e) the combined flap closer and tape applicator 300 is in a disengaged position above the conveyor 60.

FIGS. 3 and 4 illustrate the automatic random box sealer 20 measuring the box 800. At this point in time: (a) box 800 is at the box measuring position on the conveyor 40; (b) the carriage or top flap engager 110 is in the box engaging position and is engaging the top edges of the open top flaps 830, 832, and 834 of the box 800; (c) the centering arms 220 and 240 of the second box measurer 200 are in the box engaging position and have engaged the sides of the box 800 to center the box 800 at the box measuring position; (d) the box guides 66 and 68 are in the disengaged positions, and (e) the combined flap closer and tape applicator 300 is in a disengaged position above the conveyor 60.

Figure 5:
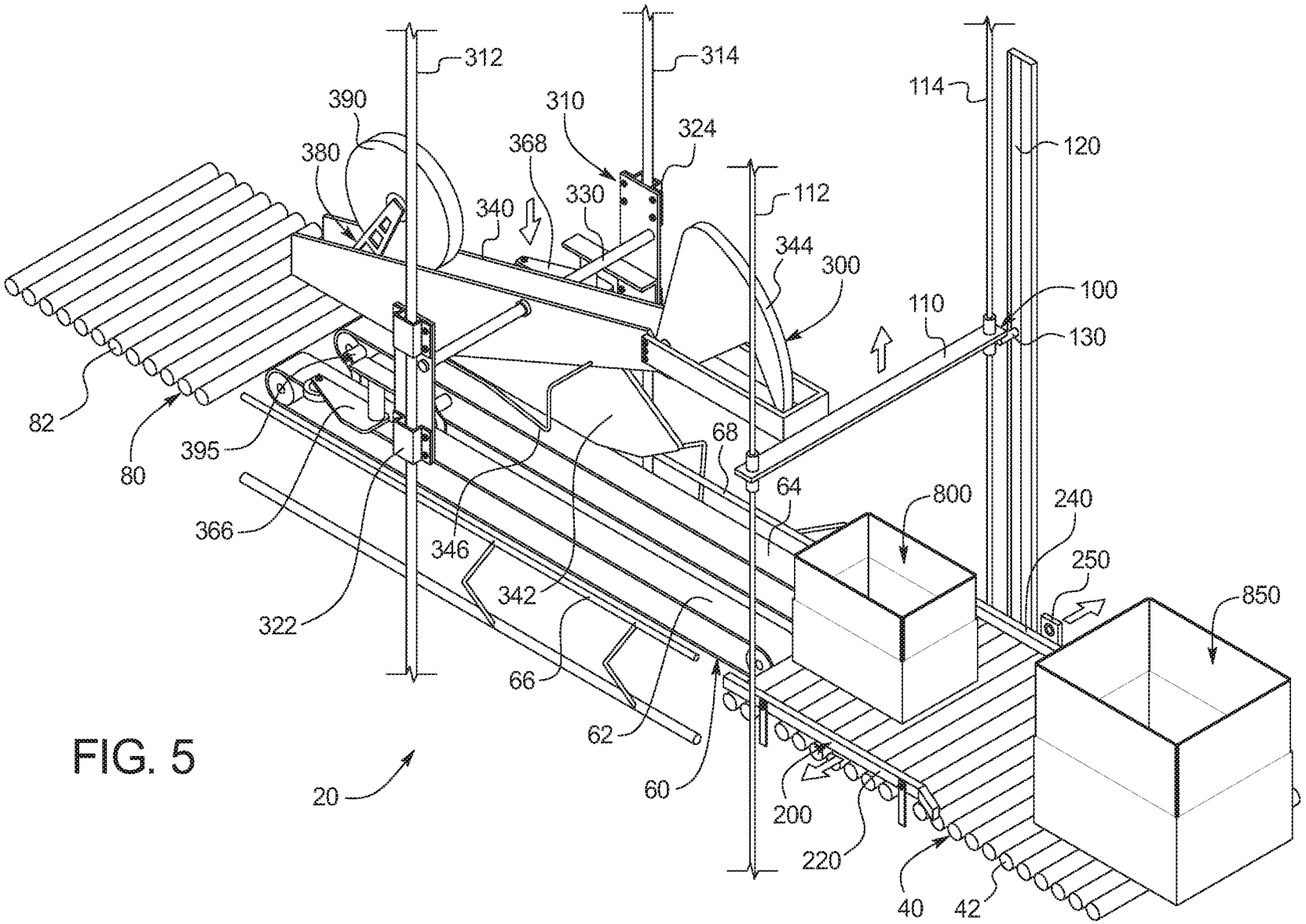
FIG. 5 is diagrammatic perspective view of the automatic random box sealer of FIG. 1, showing the first and second box measurers of the box sealer disengaged from the first size box after measuring the first size box and showing the combined flap closer and tape applicator moving downwardly to a determined position to close the flaps of and apply tape to the first size box.
Figure 6:
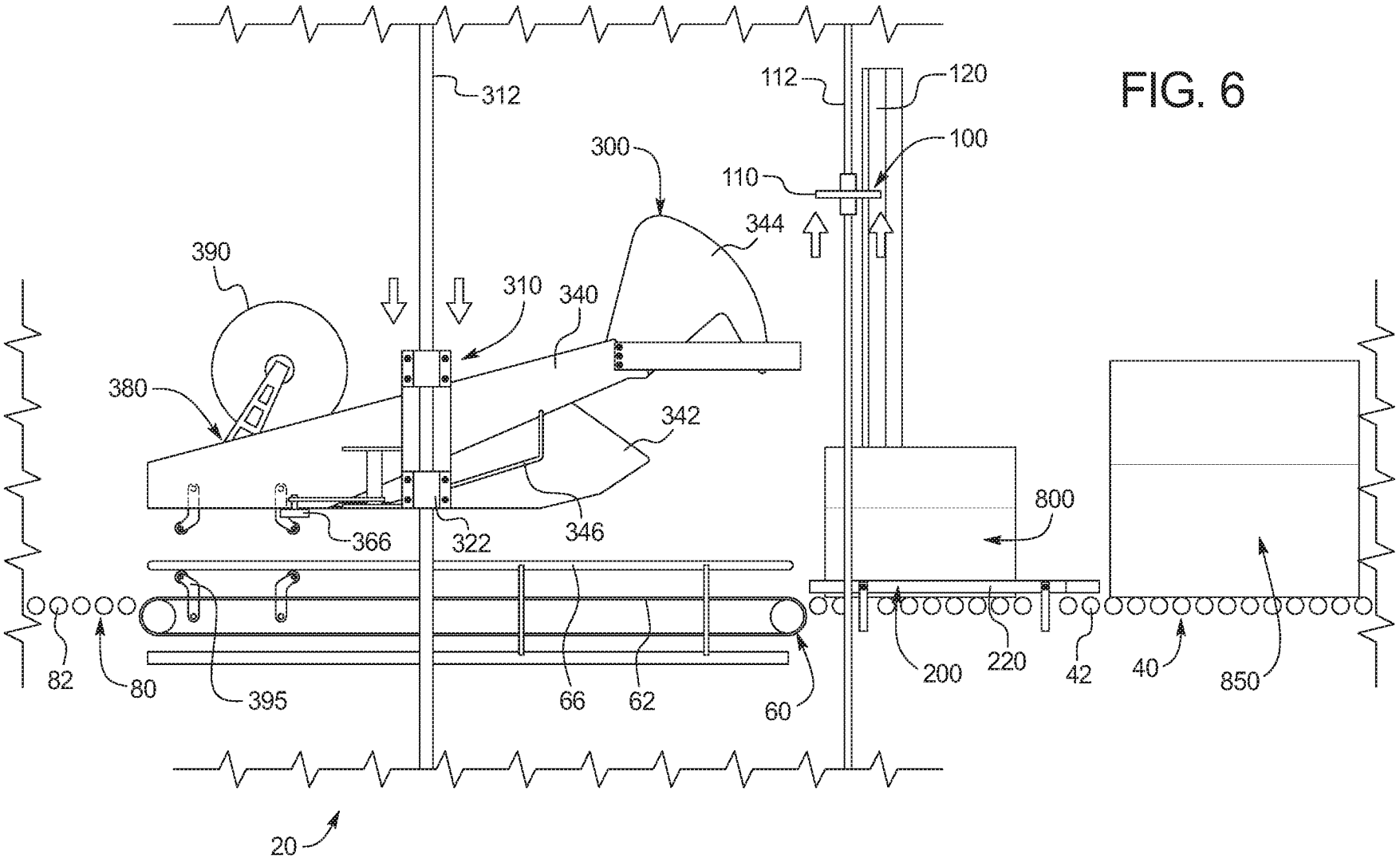
FIG. 6 is diagrammatic side view of the automatic random box sealer of FIG. 1, showing the first and second box measurers of the box sealer disengaged from the first size box after measuring the first size box and showing the combined flap closer and tape applicator moving downwardly to the determined position to close the flaps of and apply tape to the first size box.

FIGS. 5 and 6 illustrate the automatic random box sealer 20 after the measurement of box 800 have been taken and the control system has determined the height of the box. At this point in time: (a) box 800 is still at the measuring position on the conveyor 40; (b) the carriage or top flap engager 110 has moved upwardly back into a disengaged position above the box 800 and above the measuring position; (c) the centering arms 220 and 240 of the second box measurer 200 have moved outwardly away from the sides of the box 800 and are in the disengaged position; (d) the box guides 66 and 68 are in the disengaged position, and (e) the combined flap closer and tape applicator 300 has moved downwardly into a box engaging position above the conveyor 60. The position or height of the combined flap closer and tape applicator 300 is based on the determined height of the box 800.

FIGS. 7 and 8 illustrate the combined flap closer and tape applicator 300 of the automatic random box sealer 20 closing the leading upright top flap 830 of the box 800. At this point in time: (a) box 800 is on the conveyor belts 62 and 64 of conveyor 60 and under the combined flap closer and tape applicator 300, and (b) the guide arms 66 and 68 of the conveyor 60 are positioned to engage the sides of the box 800 and guide the box 800 as the box 800 is moved by the conveyor 60. Further, at this point in time, the leading flap closer 342 of the combined flap closer and tape applicator 300 is engaging and closing the leading top end flap 830 of box 800. Additionally, at this point in time, the carriage or top flap engager 110 remains in a disengaged position above the box measuring position, and the centering arms 220 and 240 of the second box measurer 200 remain in the disengaged positions. FIGS. 7 and 8 also illustrate the box 850 of a second different size moving on the conveyor 40 toward the box measuring position.

FIGS. 9 and 10 illustrate the combined flap closer and tape applicator 300 of the automatic random box sealer 20 closing the trailing upright top end top flap of box 800 and beginning to close the side upright top side flaps of box 800. At this point in time: (a) box 800 is on the conveyor belts 62 and 64 of conveyor 60 and under the combined flap closer and tape applicator 300; (b) the guide arms 66 and 68 of the conveyor 60 are positioned to engage the sides of the box 800 and guide the box 800 as the box 800 is moved by the conveyor 60; (c) the trailing flap closer 344 of the combined flap closer and tape applicator 300 has rotated downwardly and is engaging and closing the trailing top end flap of box 800, and (d) the side flap closers including side flap closer 346 are beginning to close the upright top side flaps of the box 800. Additionally, at this point in time, the carriage or top flap engager 100 remains in a disengaged position above the box measuring position, and the centering arms 220 and 240 of the second box measurer 200 remain in the disengaged positions. FIGS. 9 and 10 also illustrate box 850 on the conveyor 40 at the box measuring position. FIGS. 9 and 10 further illustrate a box 900 of a third different size moving on the conveyor 40 toward the box measuring position.

Figure 11:
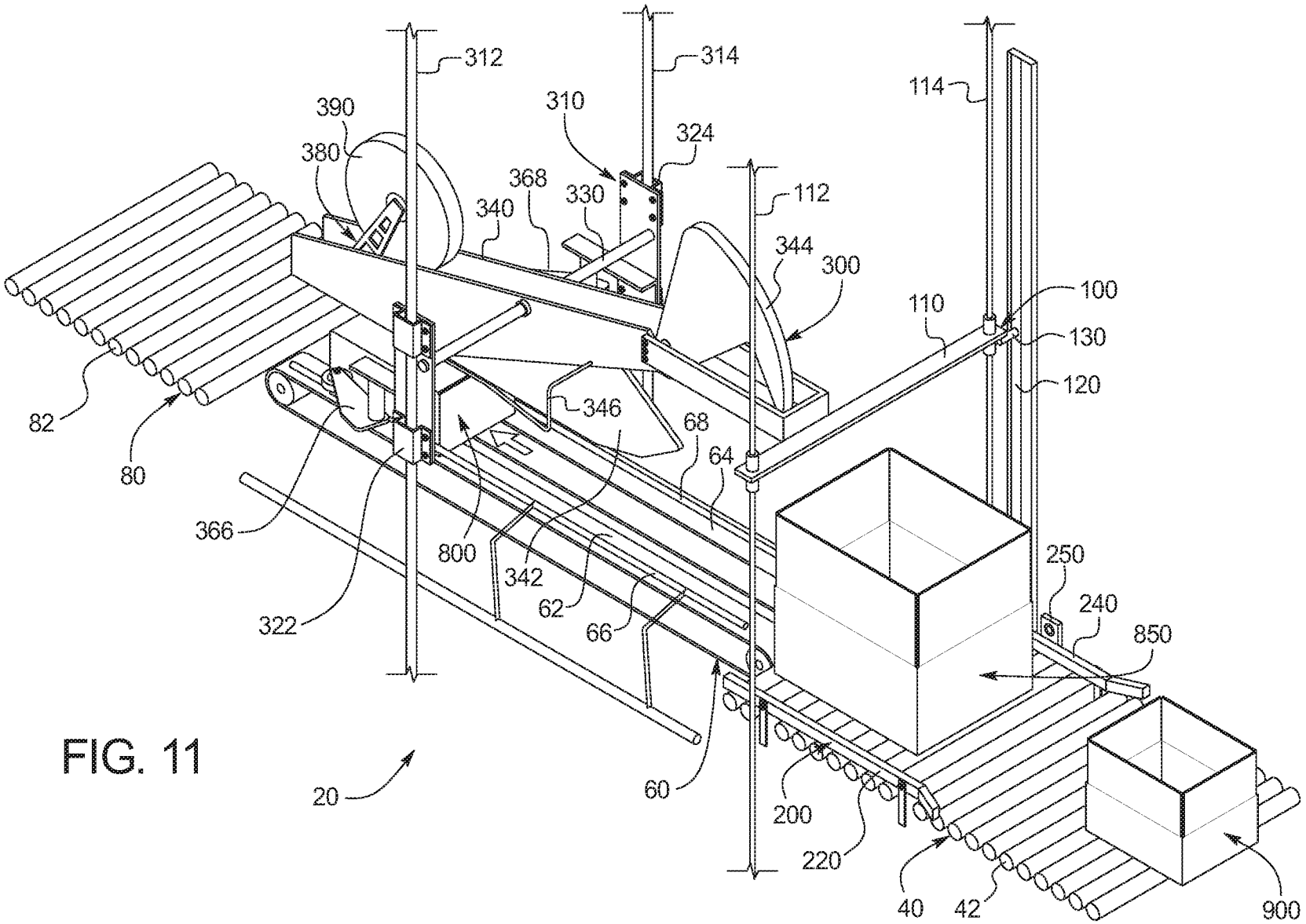
FIG. 11 is diagrammatic perspective view of the automatic random box sealer of FIG. 1, showing the combined flap closer and tape applicator applying tape to the closed flaps of the first size box, and a second larger size box positioned for measuring by the box measurer.

FIGS. 11 and 12 illustrate the combined flap closer and tape applicator 300 of the automatic random box sealer 20 applying tape to the closed side top flaps of box 800. At this point in time: (a) box 800 is on the conveyor belts 62 and 64 of conveyor 60 and under the combined flap closer and tape applicator 300; (b) the guide arms of the conveyor 60 are positioned to engage the sides of the box 800 and guide the box 800 as the box 800 is moved by the conveyor 60; (c) the side flap closers including side flat closer 346 of the combined flap closer and tape applicator 300 have closed the upright open side top flaps of box 800, and (d) the tape applicator 380 is applying tape to the closed side top flaps of box 800. Additionally, at this point in time, the carriage or top flap engager 110 remains in a disengaged position above the box measuring position, the centering arms 220 and 240 of the second box measurer 200 remain in the disengaged position. FIGS. 9 and 10 also illustrate box 850 on the conveyor 40 at the box measuring position. FIGS. 9 and 10 also illustrate the box 900 moving on the conveyor 40 toward the box measuring position.

Figure 14:
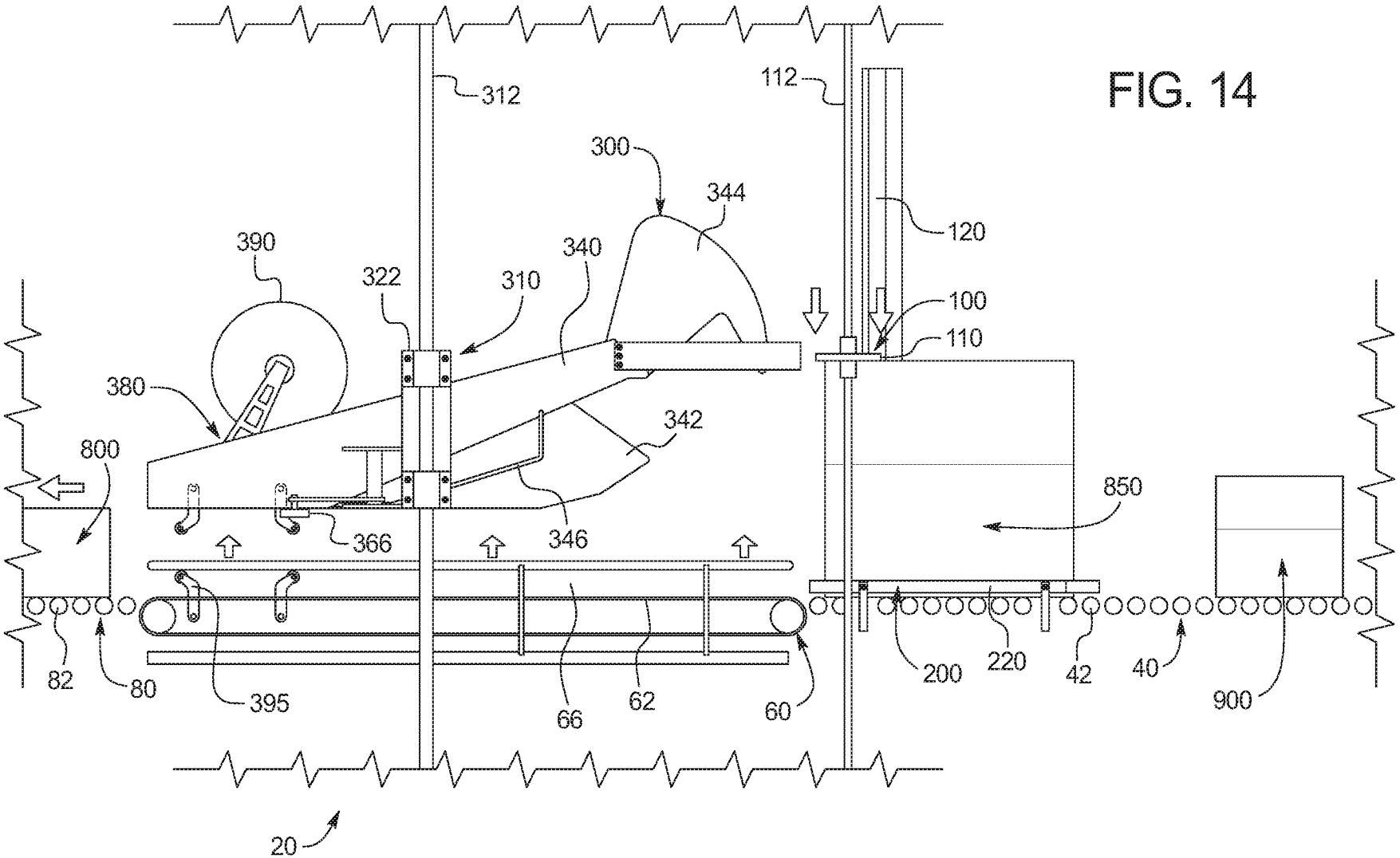
FIG. 14 is diagrammatic side view of the automatic random box sealer of FIG. 1, showing the first box measurer of the box sealer engaging three of the upright pen top flaps of the second size box and the second box measurer of the box sealer engaging the sides of the second size box.

FIGS. 13 and 14 illustrate the box 800 after the combined flap closer and tape applicator 300 and specifically the tape applicator 380 has applied tape to the closed side top flaps of the box 800 and the box 800 has moved from on the conveyor 60 to on conveyor 80. In this illustrated embodiment, the additional tape applicator has also applied tape to the closed side bottom flaps of the box 800. At this point in time, the guide arms 66 and 68 of the conveyor 60 have moved outwardly to the disengaged positions. At this point in time: (a) box 850 is at the box measuring position on the conveyor 40; (b) the carriage or top flap engager 110 has moved downwardly to an engaged position on the box 850; (c) the centering arms 220 and 240 of the second box measurer 200 are in an engaged position against the box 850 and have centered the box 850, and (d) the combined flap closer and tape applicator 300 is in a disengaged position above the conveyor 60. FIGS. 13 and 14 also illustrate the box 900 moving on the conveyor 40 toward the box measuring position.

Figure 15:
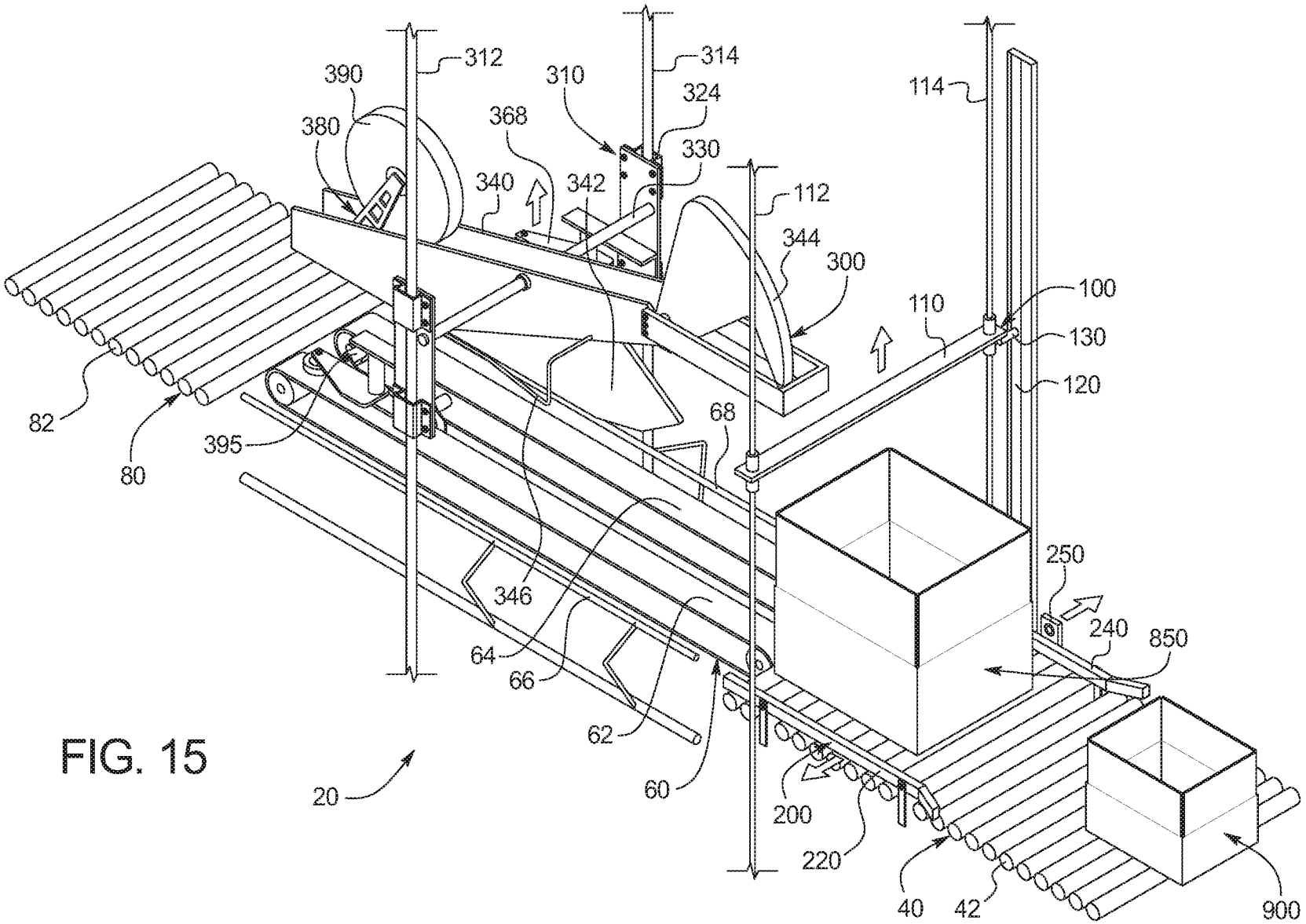
FIG. 15 is diagrammatic perspective view of the automatic random box sealer of FIG. 1, showing the first and second box measurers of the box sealer disengaged from the second size box after measuring the second size box and showing the combined flap closer and tape applicator moving upwardly to a determined position to close the upright open flaps of and apply tape to the second size box.
Figure 16:
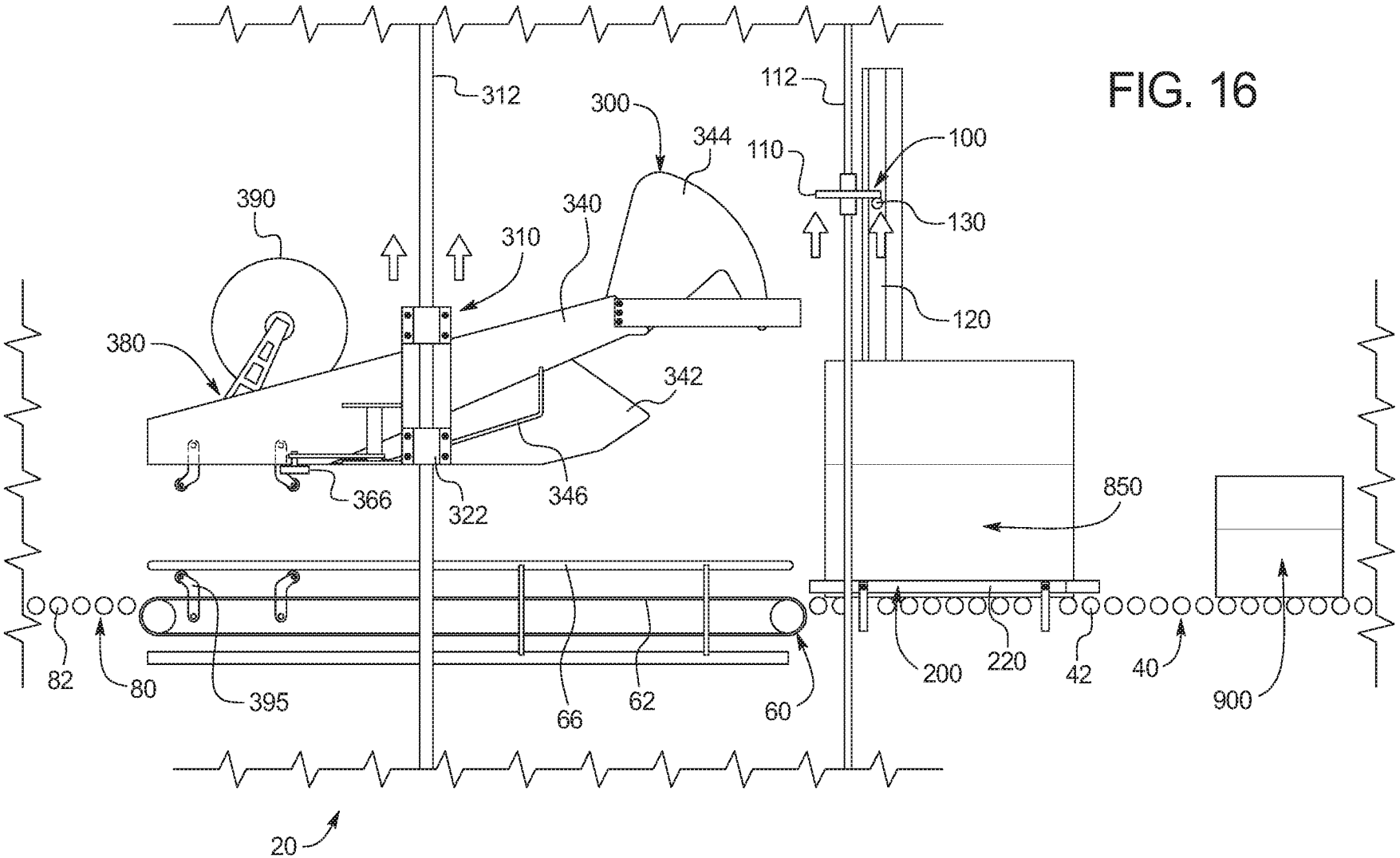
FIG. 16 is diagrammatic side view of the automatic random box sealer of FIG. 1, showing the first and second box measurers of the box sealer disengaged from the second size box after measuring the second size box and showing the combined flap closer and tape applicator moving upwardly to the determined position to close the upright open flaps of and apply tape to the second size box.

FIGS. 15 and 16 illustrate the automatic random box sealer 20 after the measurements of box 850 have been taken. At this point in time: (a) box 850 is still at the box measuring position on the conveyor 40; (b) the carriage or top flap engager 110 has moved upwardly back into a disengaged position above the box 850 and above the box measuring position; (c) the centering arms 220 and 240 of the second box measurer 200 have moved outwardly away from the sides of the box 850 and are in the disengaged position; (d) the box guides 66 and 68 are in the disengaged position; (e) the control system has determined the height of box 850; and (f) the combined flap closer and tape applicator 300 has moved upwardly into a box engaging position above the conveyor 60 based on the determination of the size of the box 850.

It should be appreciated from the above that the present disclosure thus provides method for continuously automatically sealing boxes of different sizes using a single box sealer, and for each box the method includes: (a) positioning the box at a box measuring position with the bottom flaps of the box in closed positions and the top flaps of the box in upright open positions; (b) moving a top flap engager downwardly from a disengaged position above the box to an engaged position on the box such that the top flap engager engages edges of at least one of the four upright open top flaps; (c) determining a height of the box partly based on an amount of downward movement of the top flap engager into engagement with the box; (d) positioning the box at a box closing position and positioning a flap closer at a position above the box based on the determined height of the box, and causing the flap closer to close the upright open top flaps of the box; (e) positioning the box at a box sealing position and positioning a tape applicator at a position above the box based on the determined height of the box; and (0 causing the tape applicator to seal the closed top side flaps of the box.

It should also be appreciated from the above that the method of the present disclosure further includes sealing the bottom of the box and specifically applying tape to the bottom side flaps of the box and central end walls of the box at the box sealing positions.

It should be appreciated that the order of the steps and timing described above, especially with respect to different boxes, may vary in accordance with the present disclosure. In various embodiments, the timing of each step for each box can be coordinated such that the automatic random box sealer of the present disclosure maximizes the throughput of boxes there through.

It should be appreciated that in alternative embodiments, an adhesive (such as glue) is employed to seal the top and/or bottom flaps of the box instead of or in addition to the tape. In various alternative embodiment of the present disclosure, the automatic random box sealer generally includes: (a) a conveyor system that includes one or more conveyers; (b) a first box measurer; (c) a second box measurer; (d) a combined flap closer and adhesive applicator; and (e) a control system. In certain such embodiments, the combined flap closer and adhesive applicator applies adhesive to the inner surfaces of the top side flaps and/or the outer surfaces of the top end flaps before the top side flaps are closed. It should be appreciated that in such embodiments, the adhesive is applied to the bottom flaps before the box is filled.

It should be understood that modifications and variations may be effected without departing from the scope of the novel concepts of the present disclosure, and it should be understood that this application is to be limited only by the scope of the appended claims.

The invention is claimed as follows:

1. A box sealer comprising:

(a) a conveyor system including one or more conveyors;

(b) a first box measurer including a first sensor, a second sensor, and a top flap engager movable toward and away from the one or more conveyors;

(c) a second box measurer including a plurality of centering arms movable inwardly from disengaged positions to engaged positions;

(d) a flap closer;

(e) a tape applicator; and (f) a control system configured to:

control the top flap engager to move from a disengaged position toward a box having multiple open upright flaps and positioned at a box measuring position;

receive, from the first sensor, a detection signal indicating that the first sensor has detected one of the upright open top flaps of the box and, responsive to receiving the detection signal, control the top flap engager to continue to move downward an additional distance to engage at least one of the upright open top flaps of the box and then stop;

receive, from the second sensor, a height signal associated with an amount of movement of the top flap engager;

control the centering arms to move from the disengaged positions to the engaged positions to engage opposing sides of the box;

receive, from the second box measurer, a width signal associated with an amount of movement of one of the centering arms; and determine the height of the box based on the height and width signals.

2. The box sealer of claim 1, wherein the conveyor system includes a first conveyor configured to move the box to the box measuring position.

3. The box sealer of claim 2, wherein the conveyor system includes a second conveyor configured to move the box under the flap closer and the tape applicator.

4. The box sealer of claim 1, wherein the first box measurer includes an inductive positioning system.

5. The box sealer of claim 4, wherein the inductive positioning system includes a stationary, substantially vertically extending actuator and the second sensor, which is connected to the top flap engager.

6. The box sealer of claim 4, wherein:

the second box measurer includes an ultrasonic sensor attached to one of the centering arms; and the control system is configured to at least partially control the conveyor system, the first box measurer, the second box measurer, the flap closer, and the tape applicator.

7. The box sealer of claim 6, wherein the inductive positioning system includes a stationary, substantially vertically extending actuator and the second sensor, which is connected to the top flap engager.

8. The box sealer of claim 6, wherein the top flap engager is configured to engage at least one of: a top edge of an upright open leading end top flap of the box and a top edge of at least one of a plurality of upright open side top flaps of the box.

9. The box sealer of claim 6, wherein the top flap engager is configured to engage a top edge of an upright open leading end top flap of the box, a top edge of an upright open first side top flap of the box, and a top edge of an upright open second side top flap of the box.

10. The box sealer of claim 1, wherein the first sensor is configured to detect a top edge of the one of the upright open top flaps of the box.

11. The box sealer of claim 1, wherein the top flap engager is configured to engage a top edge of an upright open leading end top flap of the box.

12. The box sealer of claim 1, wherein the top flap engager is configured to engage a top edge of an upright open side top flap of the box.

13. The box sealer of claim 1, wherein the top flap engager is configured to engage a top edge of an upright open leading end top flap of the box and a top edge of an upright open side top flap of the box.

14. The box sealer of claim 13, wherein the top flap engager is also configured to engage a top edge of an upright open second side top flap of the box.

15. The box sealer of claim 1, wherein the second box measurer includes at least one selected from the group consisting of: an ultrasonic sensor attached to one of the centering arms and an inductive positioning system.

16. The box sealer of claim 1, wherein the flap closer and the tape applicator are supported by a same support and simultaneously movable.

17. The box sealer of claim 1, wherein the control system is configured to at least partially control the conveyor system, the first box measurer, the second box measurer, the flap closer, and the tape applicator.

18. A box sealer comprising:

one or more conveyors;

a first box measurer including a first sensor, a second sensor, and a top flap engager movable toward and away from the one or more conveyors;

a second box measurer including a plurality of centering arms movable inwardly;

a carriage supporting a flap closer;

a tape applicator;

a carriage drive assembly configured to vertically move the carriage relative to the one or more conveyors; and a control system configured to:

control the top flap engager to move toward a box having multiple open upright flaps;

receive, from the first sensor, a detection signal indicating that the first sensor has detected one of the upright open top flaps of the box and, responsive to receiving the detection signal, control the top flap engager to continue to move downward an additional distance to engage at least one of the upright open top flaps of the box and then stop;

receive, from the second sensor, a height signal associated with an amount of movement of the top flap engager;

control the centering arms to move from the disengaged positions to the engaged positions to engage opposing sides of the box;

receive, from the second box measurer, a width signal associated with an amount of movement of one of the centering arms; and based on the height and width signals, control the carriage drive assembly to move the carriage vertically relative to the one or more conveyors to position the flap closer in preparation for closing the upright open top flaps of the box.

19. The box sealer of claim 18, wherein the control system is configured to determine a height of the box based on the height and width signals and control the carriage drive assembly to move the carriage based on that height.

20. A box sealer for closing and sealing multiple upright open top flaps of a box, the box sealer comprising:

a conveyor;

a first box measurer including a top flap engager;

a first box measurer drive assembly configured to vertically move the top flap engager relative to the one or more conveyors;

a second box measurer including a plurality of centering arms movable relative to the one or more conveyors;

a carriage supporting a flap closer;

a carriage drive assembly configured to vertically move the carriage relative to the one or more conveyors;

a tape applicator; and a control system configured to:

control the conveyor to move the box to a box measuring position;

control the first box measurer drive assembly to move the top flap engager downward toward the box;

receive, from the first box measurer, a detection signal indicating detection of one of the upright open top flaps of the box and, responsive to receiving the detection signal, control the top flap engager to continue to move downward an additional distance to engage at least one of the upright open top flaps of the box and then stop;

receive, from the first box measurer, a height signal associated with an amount of movement of the top flap engager;

control the centering arms to move inward to engage the box and center the box on the conveyor;

receive, from the second box measurer, a width signal associated with an amount of movement of one of the centering arms; and based on the height and width signals, control the carriage drive assembly to move the carriage relative to the one or more conveyors to position the flap closer in preparation for closing the upright open top flap of the box.

* * * * *